US012018486B2

(12) United States Patent
DePaul

(10) Patent No.: US 12,018,486 B2
(45) Date of Patent: Jun. 25, 2024

(54) CEILING SYSTEM AND METHOD OF INSTALLATION

(71) Applicant: ARMSTRONG WORLD INDUSTRIES, INC., Lancaster, PA (US)

(72) Inventor: Marie A. DePaul, Downingtown, PA (US)

(73) Assignee: AWI Licensing LLC, Wilmington, DE (US)

( * ) Notice: Subject to any disclaimer, the term of this patent is extended or adjusted under 35 U.S.C. 154(b) by 332 days.

(21) Appl. No.: 17/495,437

(22) Filed: Oct. 6, 2021

(65) Prior Publication Data

US 2022/0112715 A1 Apr. 14, 2022

Related U.S. Application Data

(60) Provisional application No. 63/089,837, filed on Oct. 9, 2020.

(51) Int. Cl.
*E04B 9/34* (2006.01)

(52) U.S. Cl.
CPC ..... *E04B 9/345* (2013.01)

(58) Field of Classification Search
CPC ..... E04B 9/122; E04B 9/125; E04B 9/0407; E04B 9/225; E04B 9/345; E04B 9/363; E04B 9/366; E04B 2001/8414; E04F 3/0862
See application file for complete search history.

(56) References Cited

U.S. PATENT DOCUMENTS

| | | | | |
|---|---|---|---|---|
| 3,378,980 | A * | 4/1968 | Blitzer, Jr. | F21V 11/06 D26/121 |
| 3,544,787 | A * | 12/1970 | Marceau | E04B 9/345 362/354 |
| 4,545,165 | A * | 10/1985 | Carey | E04B 9/345 52/506.07 |
| 4,665,674 | A * | 5/1987 | Brugman | E04B 9/127 52/506.06 |
| 4,680,910 | A * | 7/1987 | Perk | E04B 9/345 52/506.06 |
| 9,598,864 | B1 | 3/2017 | Hulka | |

FOREIGN PATENT DOCUMENTS

| | | |
|---|---|---|
| CN | 210288842 U | 4/2020 |
| JP | H08-165742 A | 6/1996 |
| JP | H09-13572 | 1/1997 |

OTHER PUBLICATIONS

International Search Report for corresponding PCT/US2021/053765 dated Feb. 4, 2022.

* cited by examiner

*Primary Examiner* — Christine T Cajilig
(74) *Attorney, Agent, or Firm* — Patrick Sheldrake

(57) ABSTRACT

A ceiling system is provided for use in a building space. The ceiling system has an open cell grid structure and is attached to a support structure of the building via hanging hardware. The open cell grid structure is constructed of a plurality of bottom panels attached to the hanging hardware, a plurality of middle panels attached to the plurality of bottom panels, and a plurality of top panels attached to the plurality of middle panels. The bottom, middle, and top panels are arranged in a plurality of rows and arranged to ensure that the plurality of panels form an interconnected system capable of being extended to any size desired by a user.

18 Claims, 19 Drawing Sheets

CEILING SYSTEM AND METHOD OF INSTALLATION

CROSS-REFERENCE TO RELATED APPLICATIONS

This application claims the benefit of U.S. Provisional Application No. of U.S. Patent Application No. 63/089,837 filed on Oct. 9, 2020. The disclosure of the above application is incorporated herein by reference.

BACKGROUND

Many types of ceiling systems exist. Ceiling systems comprising a hanging grid of acoustic panels or individual hanging panels have become increasingly popular in recent years. These systems can be used to provide noise absorption without completely covering the structure of the room or building. "Islands" of hanging panels can provide a desirable aesthetic appearance while simultaneously providing or exceeding the benefits of more traditional drop ceiling systems. These systems require that the panels be hung from a support structure. Installation can be time consuming and expensive. Therefore, a need exists for improved ceiling systems which make installation easier and reduce the complexity of the hanging systems.

SUMMARY

Embodiments of the invention provide a solution to the above problem by allowing more flexibility in grid design and more flexibility in ceiling tile construction and arrangement.

In one aspect, the invention can be a ceiling system having an open cell grid structure and hanging hardware. The open cell grid structure has a plurality of first panels, each of the first panels having a first top edge, a first bottom edge, and a plurality of first upper slots in the first top edge. The first panels are arranged in a non-intersecting arrangement so that the first bottom edges face downward. The open cell grid structure further has a plurality of second panels, each of the second panels having a second top edge, a second bottom edge, a plurality of second upper slots in the second top edge, and a plurality of second lower slots in the second bottom edge that are offset from the second upper slots. The second panels are mounted to the first panels in a first intersecting arrangement so that the second lower slots mate with the first upper slots to form primary intersection nodes, the second bottom edges facing downward. The open cell grid structure also has a plurality of third panels, each of the third panels having a third top edge, a third bottom edge, and a plurality of third lower slots in the third bottom edge. The third panels are mounted to the second panels in a second intersecting arrangement so that the third lower slots mate with the second upper slots at secondary intersection nodes, the third bottom edges facing downward. The hanging hardware is connected to each of the first panels and to a support structure to hang the open cell grid structure from the support structure in an occupied space of a building.

In another aspect, the invention can be a method of installing a ceiling system in a building. The method starts with hanging a plurality of first panels in a non-intersecting arrangement from an overhead support with hanging hardware. Each of the first panels has a first top edge, a first bottom edge, and a plurality of first upper slots in the first top edge, the first bottom edges facing downward. Second, a plurality of second panels are mounted to the first panels in a first intersecting arrangement by mating second lower slots of the second panels with the first upper slots of the first panels to form primary intersection nodes. The second lower slots are formed in second bottom edges of the second panels that face downward. Third, a plurality of third panels are mounted to the second panels in a second intersecting arrangement by mating third lower slots of the third panels with second upper slots of the second panels to form secondary intersection nodes. The third lower slots are formed in third bottom edges of the third panels that face downward. The second upper slots are formed in second top edges of the second panels, thereby forming an open cell grid structure that hangs in an occupied space of the building.

In yet another aspect, the invention can be a ceiling system having an open cell grid structure. The open cell grid structure has a plurality of bottom panel rows arranged in a non-intersecting arrangement with respect to one another, each of the plurality of bottom panel rows comprising first and second bottom panels of different axial lengths arranged in axial alignment with one another so that a bottom gap exists between adjacent side edges of the first and second bottom panels, each of the first and second bottom panels having a downwardly facing bottom edge and an upwardly facing top edge, and wherein the bottom gaps of transversely adjacent ones of the plurality of bottom panel rows are offset from one another in an axial direction of the bottom panel rows. The open cell grid structure also has a plurality of middle panel rows mounted to the bottom panel rows in a first intersecting arrangement with the plurality of bottom panel rows, each of the middle panel rows comprising at least one middle panel having a downwardly facing bottom edge and an upwardly facing top edge. The open cell grid structure also has a plurality of top panel rows mounted to the middle panel rows in a second intersecting arrangement with the middle panel rows and a non-intersecting arrangement with the bottom panel rows, each of the top panel rows comprising at least one top panel having a downwardly facing bottom edge and an upwardly facing top edge. Finally, the system has hanging hardware connected to each one of the first panel rows and to a support structure to hang the open cell grid structure from the support structure in an occupied space of a building.

In another aspect, the invention may be a method of installing a ceiling system. First, a first ceiling system kit is provided, the kit having (i) a plurality of first kit panels configured to mate with one another to form a first open cell grid structure when assembled; and (ii) first hanging hardware for hanging the first open cell grid structure. Second, a second ceiling system kit is provided, the kit having (i) a plurality of second kit panels configured to mate with one another to form a second open cell grid structure when assembled; and (ii) second hanging hardware for hanging the second open cell grid structure. Third, instructions are provided on how to mate the first and second kit panels to form a combined open cell grid structure in which no complete cell of the combined open cell grid structure has edge-to-edge interfaces or edge-to-edge gaps that oppose one another. Fourth, the combined open cell grid structure is built using the first and second ceiling system kits in accordance with the instructions in an occupied space of a building in which the combined open cell grid structure is hung from a support structure by the first and second hanging hardware.

Another aspect of the invention may be a method of installing a ceiling system. First, a plurality of bottom panel rows are hung from a support structure in a non-intersecting arrangement with one another using hanging hardware, each of the bottom panel rows comprising a first bottom panel and a second bottom panel of different axial lengths arranged in axial alignment with one another, wherein the first and second bottom panels of adjacent rows of the bottom panel rows are staggered with one another. Second, a plurality of middle panel rows are mounted to the bottom panel rows in a first intersecting arrangement with the bottom panel rows. Third, a plurality of top panel rows are mounted to the middle panel rows in a second intersecting arrangement with the middle panel rows and a non-intersecting arrangement with the bottom panel rows, each of the top panel rows comprising a first top panel and a second top panel of different axial lengths arranged in axial alignment with one another. The first and second top panels of adjacent rows of the top panel rows are staggered with one another, thereby forming an open cell grid structure.

In another embodiment, the invention is a method of installing a ceiling system. First, a first ceiling system kit is provided, the kit having (i) a plurality of first kit panels configured to mate with one another to form a first open cell grid structure having an A×B completed cell grid when assembled; and (ii) first hanging hardware for hanging the first open cell grid structure. Second, a second ceiling system kit is provided, the kit having (i) a plurality of second kit panels configured to mate with one another to form a second open cell grid structure having an X×B completed cell grid when assembled; and (ii) second hanging hardware for hanging the second open cell grid structure. Third, instructions are provided on how to mate the first and second kit panels to form a combined open cell grid structure having an A+X+1×B completed cell grid portion when assembled in which: (i) at least one of the first kit panels has a left side edge that forms a portion of a first side of a perimeter of the combined open cell grid structure; and (ii) at least one of the first kit panels has a right side edge that forms a portion of a second side of the perimeter of the combined open cell grid structure opposite the first side. Fourth, the combined open cell grid structure is built using the first and second ceiling system kits in accordance with the instructions in an occupied space of a building in which the combined open cell grid structure is hung from a support structure by the first and second hanging hardware Further areas of applicability of the present invention will become apparent from the detailed description provided hereinafter. It should be understood that the detailed description and specific examples, while indicating preferred embodiments of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

Figure 1:
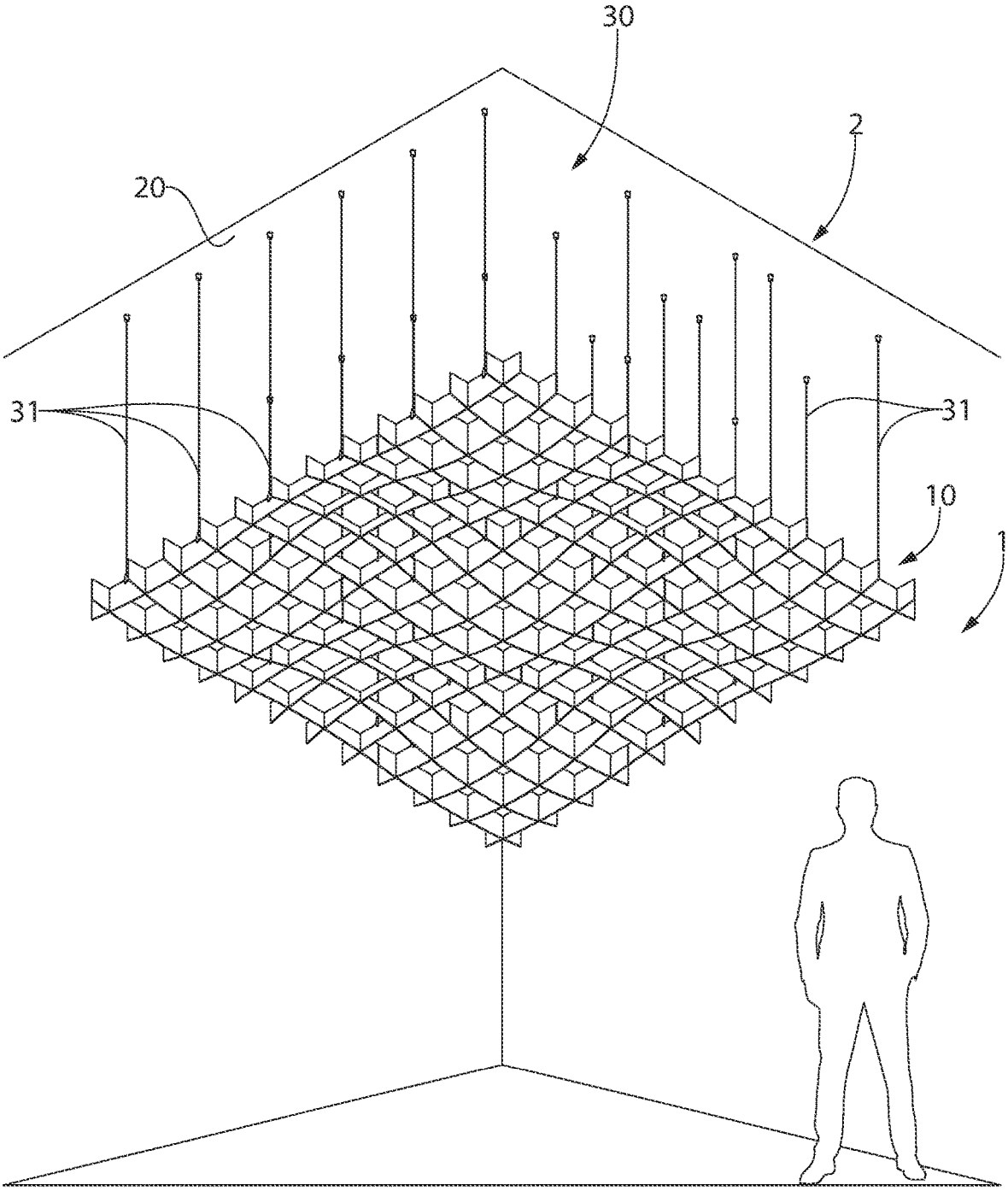
FIG. 1 is a perspective view of an occupied space in a building, with a ceiling system according to the present invention installed in the occupied space.

All drawings are schematic and not necessarily to scale. Parts given a reference numerical designation in one figure may be considered to be the same parts where they appear in other figures without a numerical designation for brevity unless specifically labeled with a different part number and described herein.

DETAILED DESCRIPTION

The following description of the preferred embodiment(s) is merely exemplary in nature and is in no way intended to limit the invention, its application, or uses.

In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "connected," "coupled," "interconnected," and similar refer to a relationship wherein structures are secured or attached to one another either directly or indirectly through intervening structures, as well as both movable or rigid attachments or relationships, unless expressly described otherwise. The term "fixed" refers to two structures that cannot be separated without damaging one of the structures. The term "filled" refers to a state that includes completely filled or partially filled.

As used throughout, ranges are used as shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

FIG. 1 shows an occupied space 1 in a building 2. A ceiling system 10 is attached to a support structure 20 such as the building's roof, trusses, or other structure forming an interior of the building 2. The ceiling system 10 is attached to the support structure 20 via hanging hardware 30. The ceiling system 10 forms a floating island structure that is not directly connected to any walls within the building 2. Instead, the ceiling system 10 is exclusively connected to the support structure 20, the ceiling support structure 20 being a roof, roof trusses, ceiling, or ceiling structural members of the interior of the building 2. The hanging hardware 30 may comprise wire, rods, or any other tensile member capable of supporting the components of the ceiling system 10. In one embodiment the hanging hardware 30 is a plurality of individual tensile members 31, each tensile member 31 comprising a first hook attached to the support structure 20, a wire connected to the first hook, and a second hook connected to the wire and to a panel of the ceiling system 10. The number of tensile members 31 utilized to support the ceiling system 10 depends on a variety of factors including the area covered by the ceiling system 10, the strength of the ceiling system 10 and the strength of the support structure 20, the availability of suitable connection points on the support structure 20, and a variety of other factors.

Figure 2:
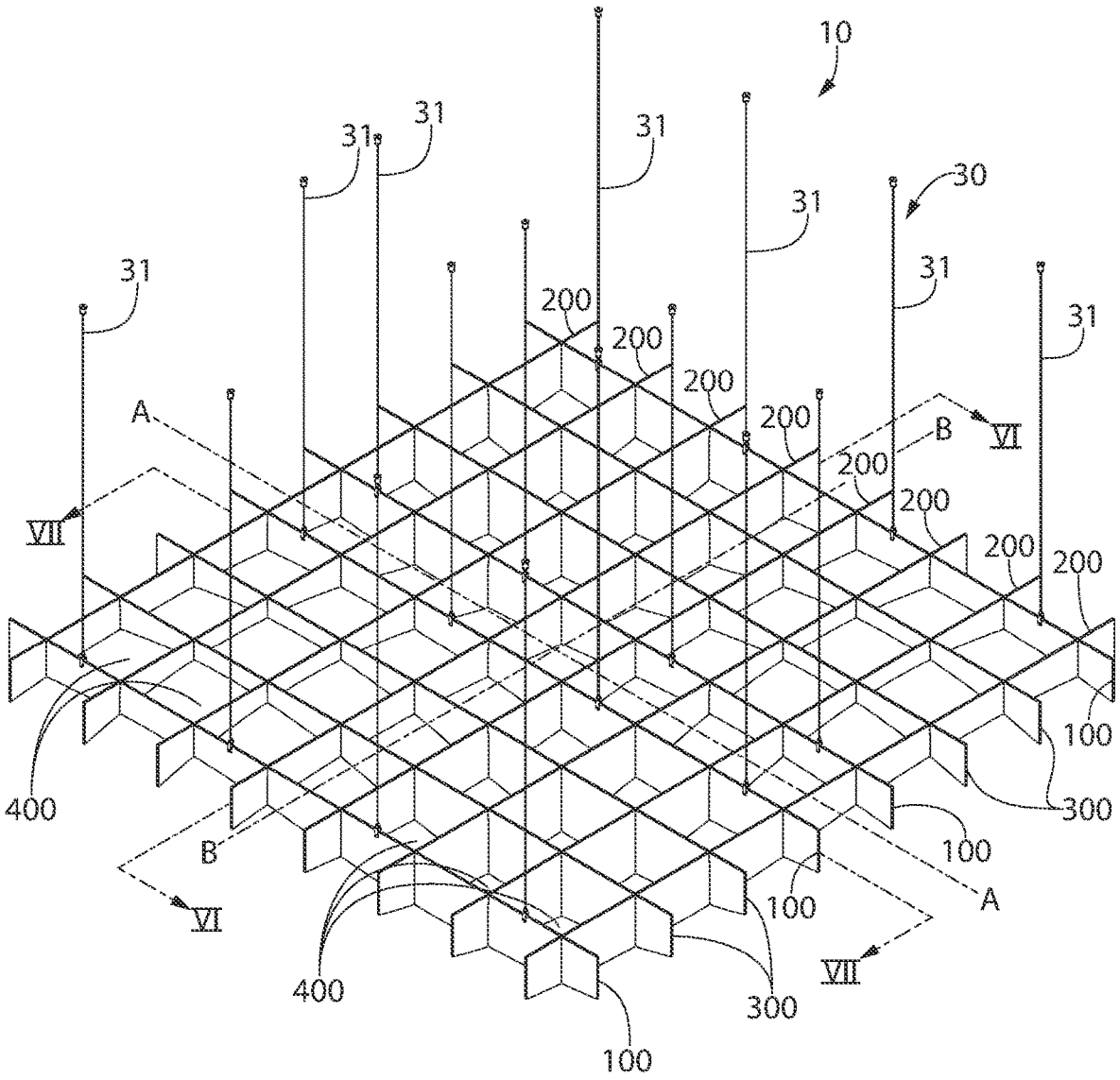
FIG. 2 is a perspective view of the ceiling system of FIG. 1.

FIG. 2 shows the ceiling system 10 in greater detail. The ceiling system 10 has a plurality of first panels 100, a plurality of second panels 200, and a plurality of third panels 300. The plurality of first panels 100 are arranged such that they are substantially parallel to a first axis A-A and do not intersect with other ones of the first panels 100. Each of the first panels 100 is attached to the support structure 20 via one or more tensile members 31 of the hanging hardware 30 and hang downward due to the force applied by gravity. The plurality of second panels 200 extend substantially parallel to the second axis B-B such that each one of the second panels 200 does not intersect other ones of the second panels 200. Each of the plurality of second panels 200 are free of tensile members 31.

Each of the plurality of second panels 200 do intersect the plurality of first panels 100. The first axis A-A is substantially perpendicular to the second axis B-B. As a result, the plurality of first panels 100 is substantially perpendicular to the plurality of second panels 200. The plurality of third panels 300 are substantially parallel to other ones of the plurality of third panels 300 and substantially parallel to the plurality of first panels 100. The plurality of third panels 300 are also substantially parallel to the first axis A-A. The plurality of third panels 300 do not intersect other ones of the plurality of third panels 300 or any of the plurality of first panels 100. Each of the plurality of third panels 300 are free of tensile members 31. In other embodiments, the second axis B-B may not be perpendicular to the first axis A-A.

As can be seen, the pluralities of first, second, and third panels 100, 200, 300 form a rectilinear grid. Thus, the ceiling system 10 forms an open cell grid structure. A plurality of open cells 400 are formed between the pluralities of first, second, and third panels 100, 200, 300. Ideally, the open cells 400 are of substantially equal cross-sectional area. In other embodiments, the open cells 400 may be of different cross-sectional area. The open cells 400 are ideally rectangular or square in shape, but may also take other shapes.

In the preferred embodiment, the plurality of first panels 100 comprise a first end first panel 100, a second end first panel 100, and a pair of central first panels 100 adjacent one another and located between the first and second end first panels 100. At least one third panel 300 is located between the first end first panel 100 and the pair of central first panels 100. At least one third panel 300 is also located between the second end first panel 100 and the pair of central first panels 100. Preferably, two third panels 300 are located between the first end first panel 100 and the pair of central first panels 100. In addition, two third panels 300 are preferably located between the second end first panel 100 and the pair of central first panels 100.

Figure 3:
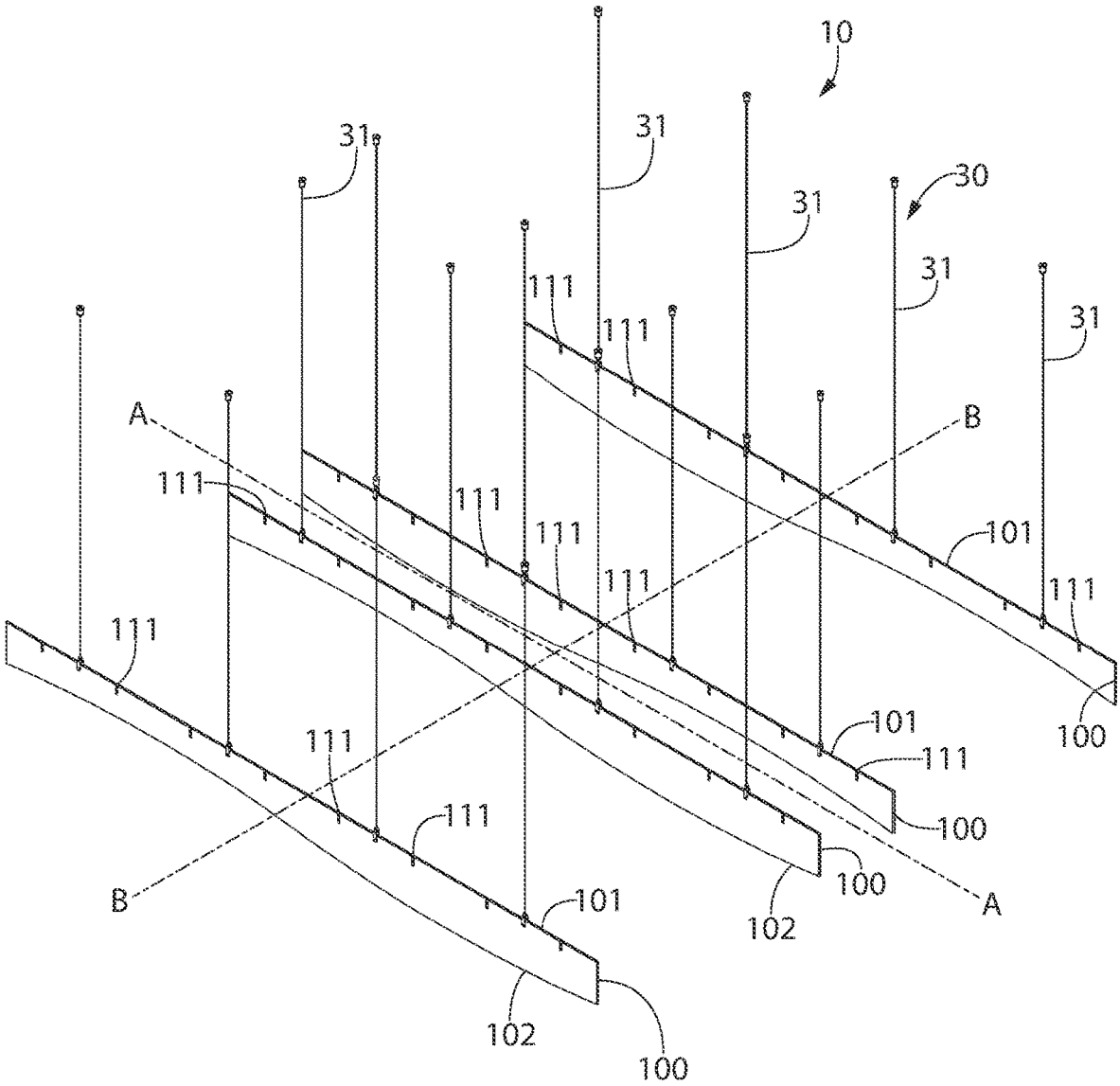
FIG. 3 is a perspective view of the first panels of the ceiling system of FIG. 1 during installation of the first panels.
Figure 4:
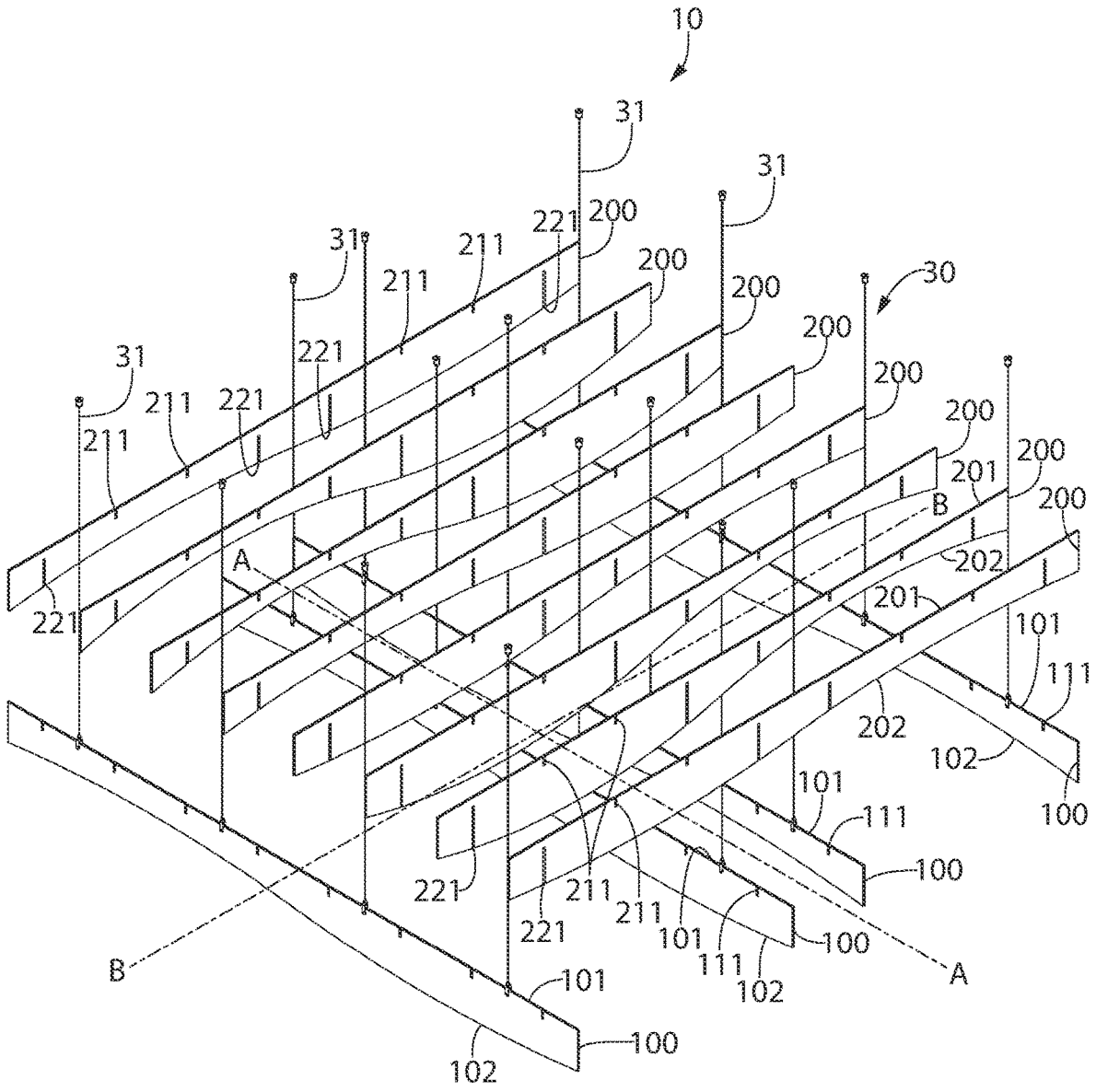
FIG. 4 is a perspective view of the first and second panels of the ceiling system of FIG. 1, the second panels being positioned to permit assembly with the first panels.
Figure 5:
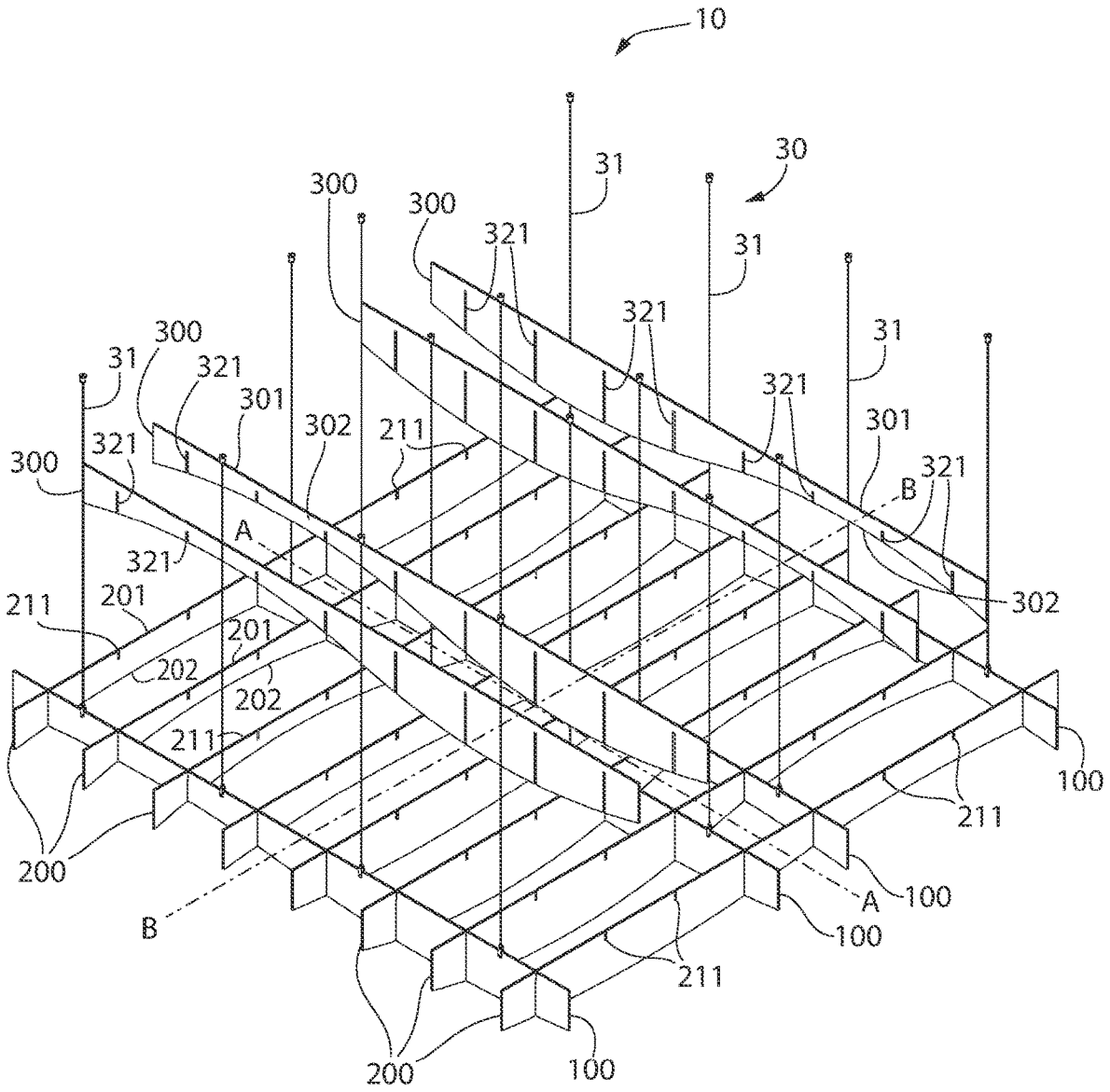
FIG. 5 is a perspective view of the first, second, and third panels of the ceiling system of FIG. 1, the third panels being positioned to permit assembly with the second panels.

FIGS. 3-5 show the ceiling system 10 in various states of assembly. FIG. 3 shows the plurality of first panels 100 installed in a first step. The plurality of first panels 100 are installed to the hanging hardware 30, with a plurality of tensile members 31 attached to each of the first panels 100. As discussed above, the plurality of first panels 100 are arranged in a non-intersecting and substantially parallel arrangement. Each of the first panels 100 have a first top edge 101, a first bottom edge 102, and a plurality of first upper slots 111 in the first top edge 101. Each of the first bottom edges 102 of the plurality of first panels 100 extend downward. Gravity ensures that the plurality of first panels 100 hang downward and are retained in position as shown in FIG. 3.

FIG. 4 shows a second step of assembling the ceiling system 10. The plurality of first panels 100 are shown in their assembled position along with the plurality of second panels 200 oriented prior to installation. The plurality of second panels 200 each have a second top edge 201, a second bottom edge 202, a plurality of second lower slots 221, and a plurality of second upper slots 211. The plurality of second lower slots 221 are located on the second bottom edge 202. The plurality of second upper slots 211 are located on the second top edge 201. Each of the plurality of second panels 200 is mounted to the plurality of first panels 100 by mating the second lower slots 221 of the second panels 200 to the first upper slots 111 of the first panels 100. This results in an interlocking arrangement that forms a plurality of primary intersection nodes. The weight of the plurality of second panels 200 is then supported by the plurality of first panels 100 at the plurality of primary intersection nodes. The plurality of primary intersection nodes will be discussed in greater detail below. Gravity ensures that the plurality of second panels 200 remain interlocked with the plurality of first panels 100. No other fastening is required, although additional fasteners may be added if so desired.

FIG. 5 shows a third step of assembling the ceiling system 10. The plurality of first panels 100 are shown assembled with the plurality of second panels 200. The plurality of third panels 300 are shown oriented prior to installation. Each of the plurality of third panels 300 are oriented substantially parallel to the plurality of first panels 100. Each of the plurality of third panels 300 has a third top edge 301, a third bottom edge 302, and a plurality of third lower slots 321. The plurality of third lower slots 321 is located on the third bottom edge 302 of the third panels 300. Each of the plurality of third panels 300 is mounted to the plurality of second panels 200 by mating the third lower slots 321 of the third panels 300 to the second upper slots 211 of the second panels 200. This results in an interlocking arrangement that forms a plurality of secondary intersection nodes.

The weight of the plurality of third panels 300 is then supported by the plurality of second panels 200 at the plurality of secondary intersection nodes. The weight of the plurality of third panels 300 is carried to the plurality of first panels 100 via the primary intersection nodes formed by plurality of second panels 200 with the plurality of first panels 100. The plurality of secondary intersection nodes will be discussed in greater detail below. Gravity ensures that the plurality of third panels 300 remain interlocked with the plurality of second panels 200. No other fastening is required, although additional fasteners may be added if so desired. None of the plurality of third panels 300 is directly supported by any one of the plurality of first panels 100. Instead, the third panels 300 are spaced and isolated from the first panels 100. Preferably, each of the first, second, and third top edges 101, 201, 301 are substantially flush at the primary and secondary intersection nodes. In one embodiment, each of the first, second, and third top edges 101, 201, 301 lie in the same plane.

Figure 6:
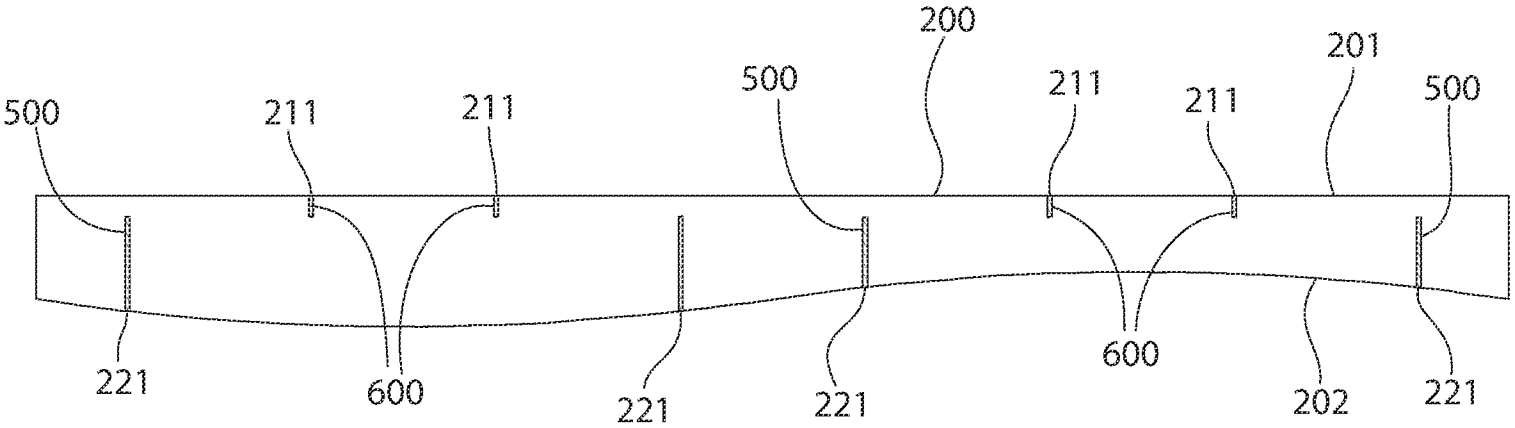
FIG. 6 is a cross-section view of the ceiling system along line VI-VI of FIG. 2.

FIG. 6 shows a cross section taken along the line VI-VI in FIG. 2 showing the primary intersection nodes 500 and secondary intersection nodes 600. The primary intersection nodes 500 are formed by the intersection of the plurality of first panels 100 with the plurality of second panels 200, with the first panels 100 engaging the second lower slots 221 at the primary intersection nodes 500. The second intersection nodes 600 are formed by the intersection of the plurality of second panels 200 with the plurality of third panels 300, with the third panels 300 engaging the second upper slots 211 of the second panels 200. Thus, the plurality of first upper slots 111 and the plurality of second lower slots 221 mate to form the first intersection nodes 500. The plurality of second upper slots 211 and the plurality of third lower slots 321 mate to form the second intersection nodes 600.

Figure 7:
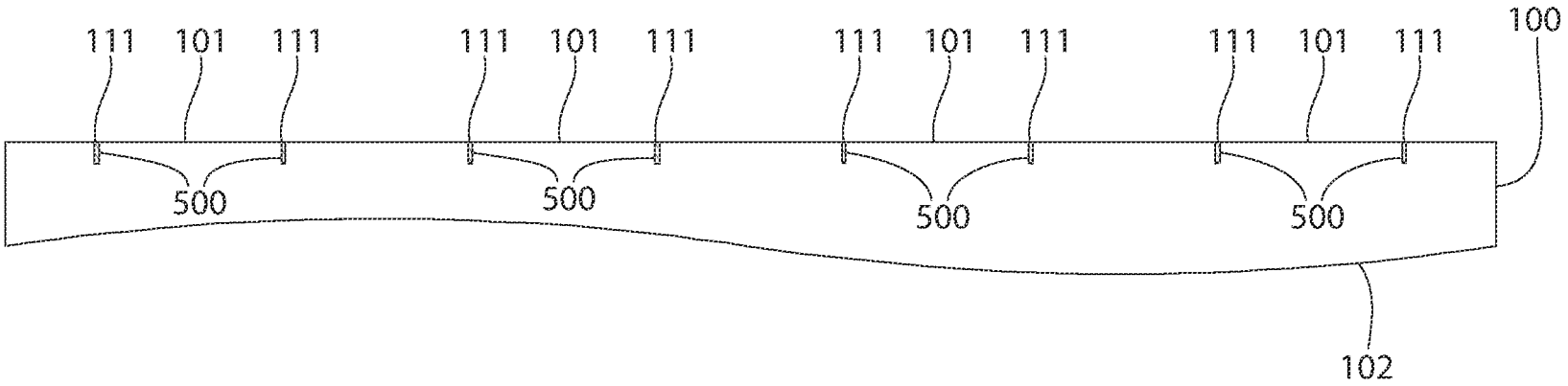
FIG. 7 is a cross-section view of the ceiling system along line VII-VII of FIG. 2

FIG. 7 shows a cross section taken along line VII-VII in FIG. 2 showing the primary intersection nodes 500 from a different perspective. One of the plurality of first panels 100 can be seen with a the plurality of primary intersection nodes 500 formed by the plurality of second panels 200 being inserted into the first upper slots 111 of the first panel 100.

Figure 8:
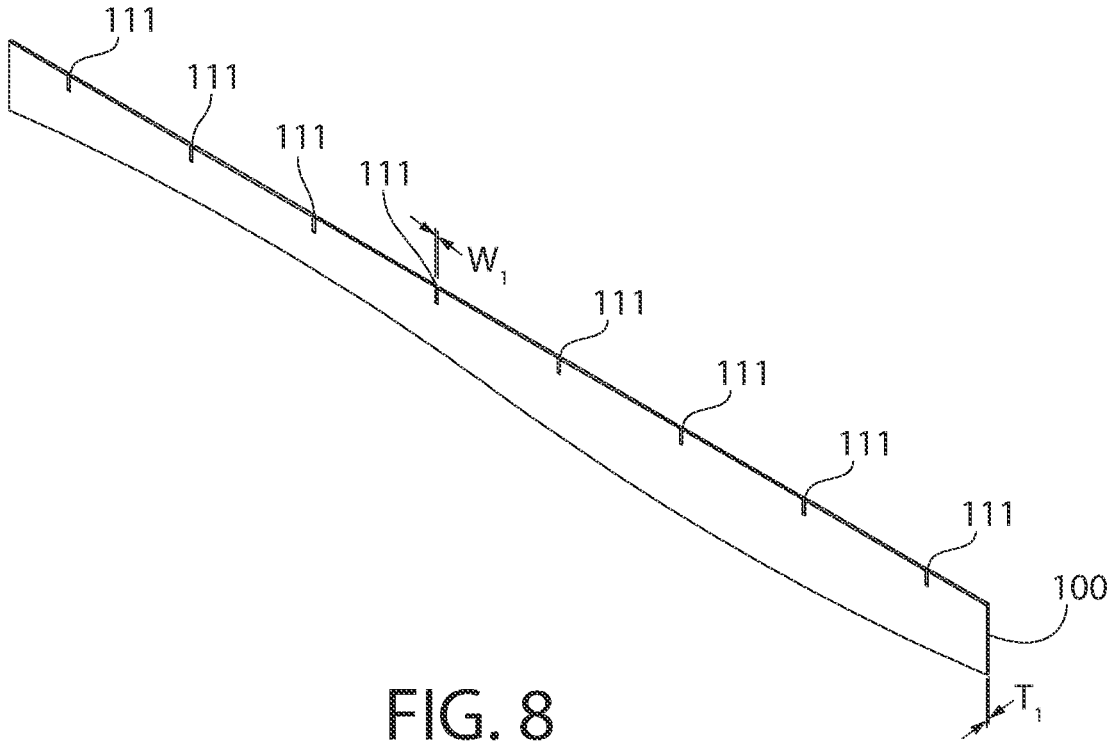
FIG. 8 is a perspective view of a first panel of the ceiling system of FIG. 1.
Figure 9:
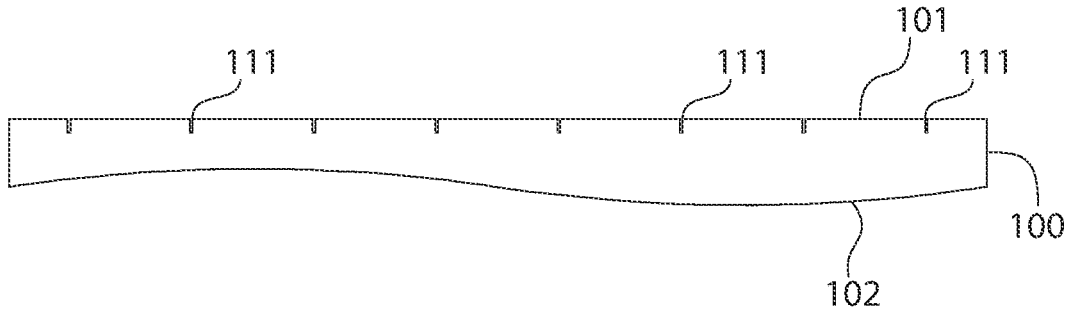
FIG. 9 is a side view of a first panel of the ceiling system of FIG. 1.

FIGS. 8 and 9 show a perspective view and a side view of one of the first panels 100. As discussed previously, the first panel 100 has a plurality of first upper slots 111, a first top edge 101, and a first bottom edge 102. The first panel 100 is free of slots on the first bottom edge 102. The first panel 100 also has a panel thickness $T_1$. As can be seen, each of the first upper slots 111 are of equal height and of equal width. However, in other embodiments, the first upper slots 111 may have different heights. Each of the first upper slots 111 have a width $W_1$. In some embodiments, the first upper slots 111 may have different widths to accommodate different thicknesses of panels. In the present embodiment, the first top edge 101 is linear or straight and the first bottom edge 102 has a curvilinear shape. Thus, the first bottom edge 102 has both convex and concave shapes. In some embodiments, the first top edge 101 may have a curvilinear shape. In yet other embodiments, the first bottom edge 102 may be linear or have a shape formed by a plurality of linear segments which are non-parallel. It is important to note that not all of the plurality of first panels 100 are necessarily identical. Indeed, in most installations the first panels 100 may have different shapes to provide a varying height along the first axis A-A and along the second axis B-B. In some embodiments, all of the first panels 100 may have the same shape on the first bottom edges 102 to provide a more uniform appearance.

Figure 10:
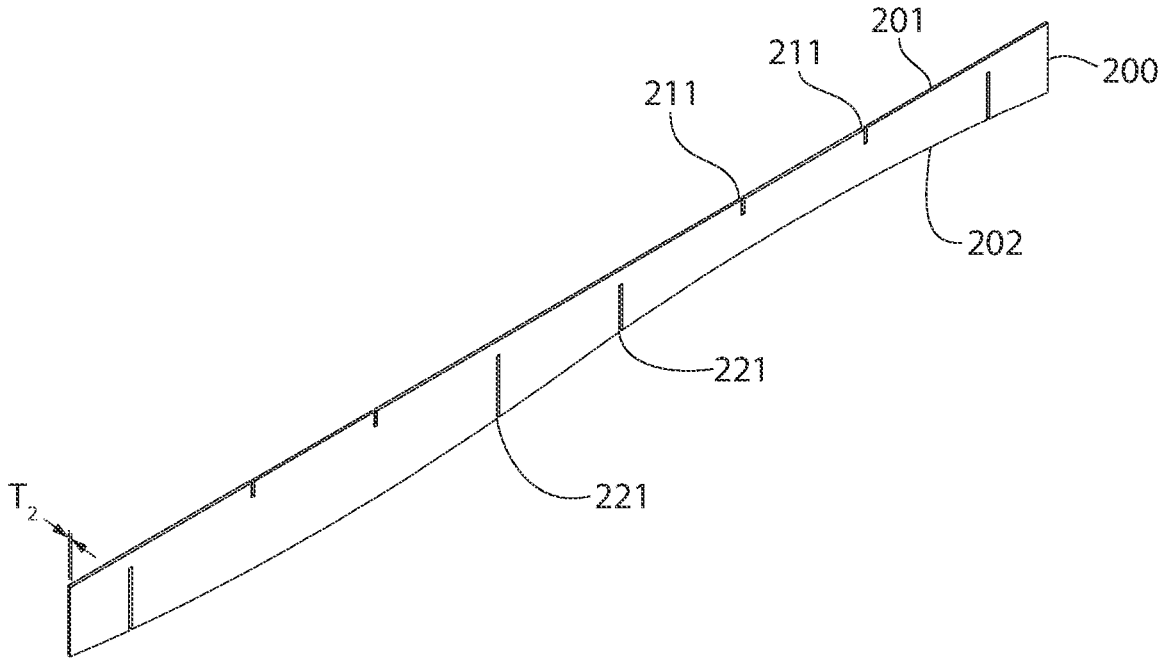
FIG. 10 is a perspective view of a second panel of the ceiling system of FIG. 1.
Figure 11:
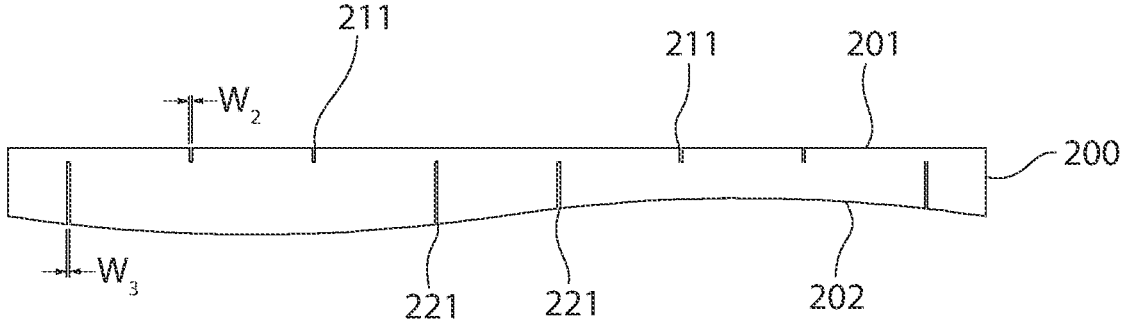
FIG. 11 is a side view of a second panel of the ceiling system of FIG. 1.

FIGS. 10 and 11 show a perspective view and a side view of one of the second panels 200. The second panel 200 has a plurality of second upper slots 211 that are equal in height and equal in width. The second panel 200 also has a plurality of second lower slots 221, the plurality of second lower slots 221 having a varying height and equal width. The second panel 200 has a panel thickness $T_2$. Each of the second upper slots 211 have a width $W_2$. Each of the second lower slots 221 have a width $W_3$. In other embodiments, the second upper slots 211 may have differing height or width and the second lower slots 221 may have equal height and differing width.

In the present embodiment, the second top edge 201 is straight and the second bottom edge 202 has a curvilinear shape comprising both convex and concave shapes. As with the first panels 100, the second top edge 201 and the second bottom edge 202 may be linear or curvilinear or have a shape formed by a plurality of linear segments which are non-parallel. As with the first panels 100, the second panels 200 need not be identical, and may vary to provide the appearance of texture as a result of the varying height of the panels 200 along both the first axis A-A and the second axis B-B. The second lower slots 221 of the present embodiment are varying in height but equal in width. This is done to compensate for the curved second bottom edge 202. By altering the height of the second lower slots 221, the second top edge 201 lies in the same plane as the first top edge 101 when the first panels 100 and the second panels 200 are assembled. In alternate configurations, the second lower slots 221 may be altered in height and the first upper slots 111 may be altered in height so that the first and second top edges 101, 201 lie in the same plane. In yet other embodiments, the first and second top edges 101, 201 may not lie in the same plane. In addition, the first bottom edge 102 and the second bottom edge 202 of each of the first and second panels 100, 200 are substantially flush at the primary intersection nodes. However, alternate configurations may have the first bottom edge 102 and the second bottom edge 202 at different heights.

Figure 12:
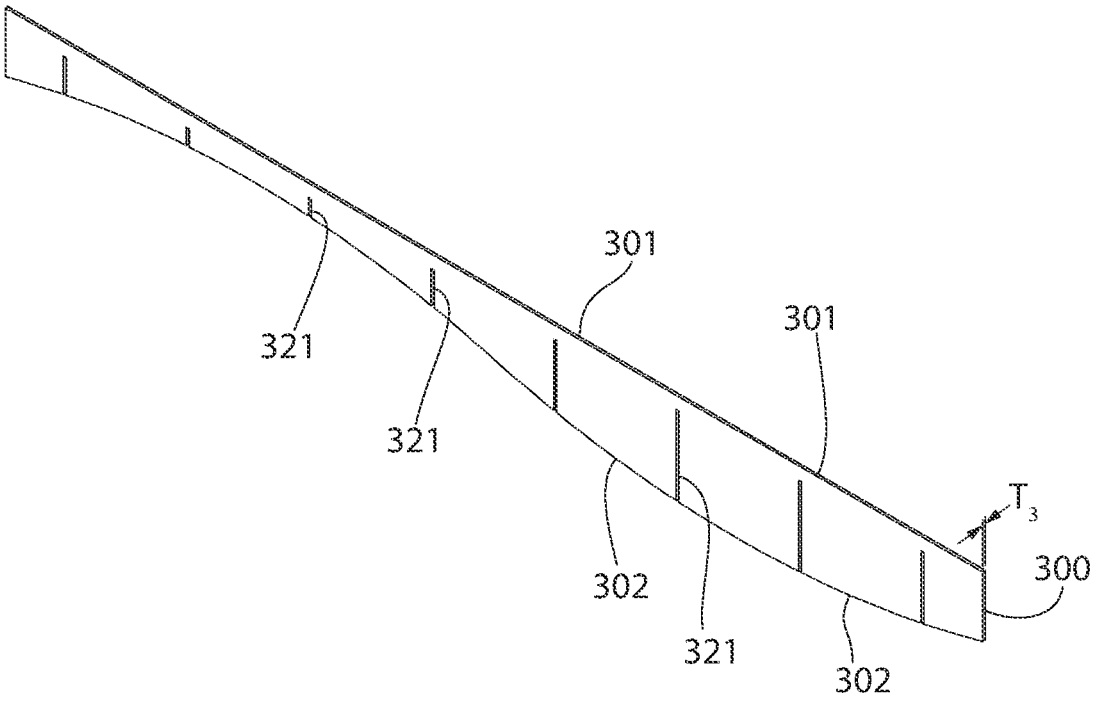
FIG. 12 is a perspective view of a third panel of the ceiling system of FIG. 1.
Figure 13:
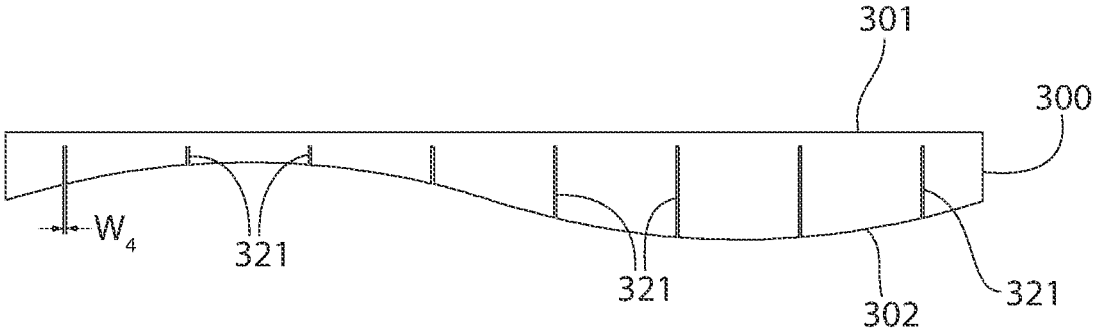
FIG. 13 is a side view of a third panel of the ceiling system of FIG. 1.

FIGS. 12 and 13 show a perspective view and a side view of one of the third panels 300. The third panel 300 has a plurality of third lower slots 321 on the third bottom edge 302 having a width $W_4$ and a plurality of unequal heights. The third top edge 301 is free of slots. As discussed above with respect to the second lower slots 221, the third lower slots 321 may be of equal height or equal width. The third panel 300 has a panel thickness $T_3$, a third top edge 301 and a third bottom edge 302. The third top edge 301 is linear and the third bottom edge 302 is curvilinear. When the third panels 300 are mated with the second panels 300, the third top edges 301 and the second top edges 201 are substantially flush at the secondary intersection nodes 600 and lie in the same plane as the first and second top edges 101, 201. The second bottom edges 202 and the third bottom edges 302 are flush at the secondary intersection nodes 600. However, in alternate embodiments the second and third top edges 201, 301 may not be flush. In alternate embodiments the second and third bottom edges 202, 302 may also not be flush. The height of the second upper slots 211 and the third bottom slots 321 may vary. The third bottom edges 302 may be curvilinear, linear or have a shape formed by a plurality of linear segments which are non-parallel. Each of the third panels 300 need not be identical.

As discussed above, different shapes of the first, second, and third panels 100, 200, 300 may be used to create a textured appearance that varies along the first axis A-A, along the second axis B-B, or along both the first and second axes A-A, B-B. As best shown in FIG. 1, the textured appearance provided by the bottom edges 102, 202, 302 can be seen in greater detail. This shape can be constructed by gradually altering the shapes of the first, second, and third bottom edges 102, 202, 303 such that the resulting ceiling system 10 has the appearance of a wave, a saw tooth, or any other shape.

Preferably, the first, second, and third panels 100, 200, 300 are acoustical panels. The panels 100, 200, 300 are preferably constructed of a sound absorbing material. The sound absorbing material may be formed into a non-woven fabric, a foam material, or other structure that provides adequate rigidity to support the weight of the assembled first, second, and third panels 100, 200, 300. In one embodiment, the panels 100, 200, 300 have sufficient rigidity that when mounted in a cantilevered fashion, a tip of a cantilevered portion of the panels 100, 200, 300 of 1 meter in length does not bend at greater than a 45 degree angle from the horizontal plane as a result of gravity. Thus, the panels 100, 200, 300 are sufficiently rigid that they do not collapse when cantilevered for a distance of 1 meter. The panels 100, 200, 300 should provide a noise reduction coefficient ("NRC") rating of at least 0.6. The panels 100, 200, 300 may be constructed of a polyester felt. Alternately, mineral wool, fiberglass, or various plastic materials may be used. Ideally, the panels 100, 200, 300 are constructed of 6.35 mm thick polyester felt material.

In the preferred embodiment, each of the panels 100, 200, 300 have the same panel thickness. Thus, the thickness $T_1$ of the plurality of first panels 100 is equal to the thickness $T_2$ of the plurality of second panels 200, which is in turn equal to the thickness $T_3$ of the plurality of third panels 300. Preferably, the widths $W_1$, $W_2$, $W_3$, $W_4$ are greater than the thicknesses $T_1$, $T_2$, $T_3$ of the panels 100, 200, 300. This ensures easy assembly of the panels 100, 200, 300 without the need to force the panels together. However, an interference fit may be used to further improve retention of the panels 100, 200, 300. Preferably, the widths $W_1$, $W_2$, $W_3$, $W_4$ are equal. However, different widths may be utilized in concert with different panel heights to provide a unique visual impression.

Figure 14:
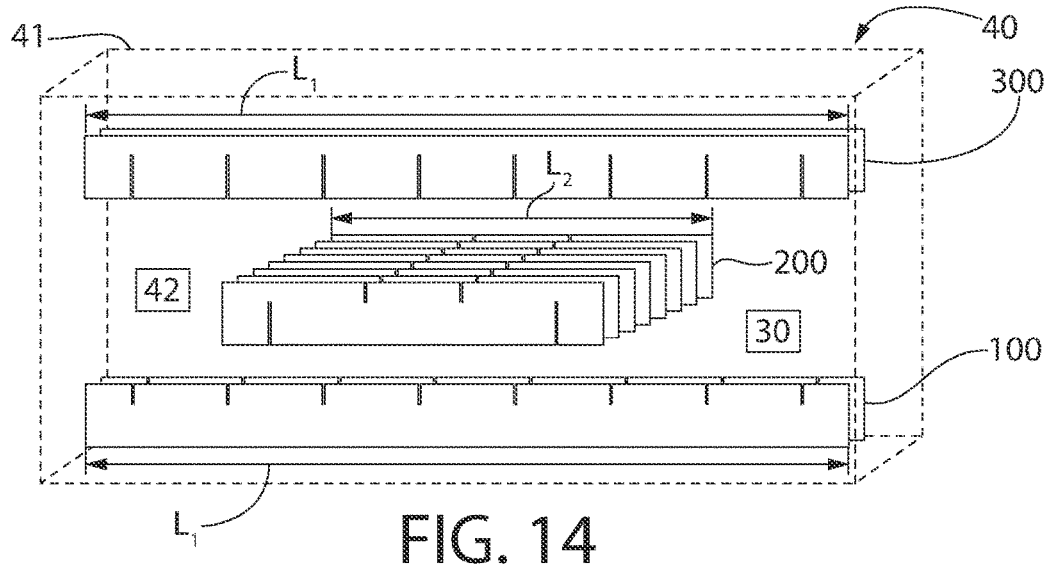
FIG. 14 is a representation of a first ceiling system kit of the ceiling system of FIG. 1.

Turning to FIG. 14, this figure shows a first ceiling system kit 40 comprising a plurality of panels. The kit 40 comprises a plurality of first panels 100, a plurality of second panels 200, and a plurality of third panels 300. The kit 40 further comprises a package 41, hanging hardware 30, and instructions 42. The package 41 may be a box, a crate, or any other known means for containing the components of the ceiling system kit 40. The instructions 42 may be a book, paper instruction sheets, a representation on the product packaging. Alternately, the instructions 42 may be provided in electronic format such as a PDF or a website, with the packaging comprising a link or other reference to the website. For the purposes of clarifying the assembly sequence, the plurality of first panels 100 are sometimes referred to as bottom panels 100. Similarly, the second panels 200 are sometimes referred to as middle panels 200 and the third panels 300 are sometimes referred to as top panels 300. Furthermore all details discussed above with respect to the construction, arrangement, and assembly of the panels is identical unless otherwise noted.

Figure 15:
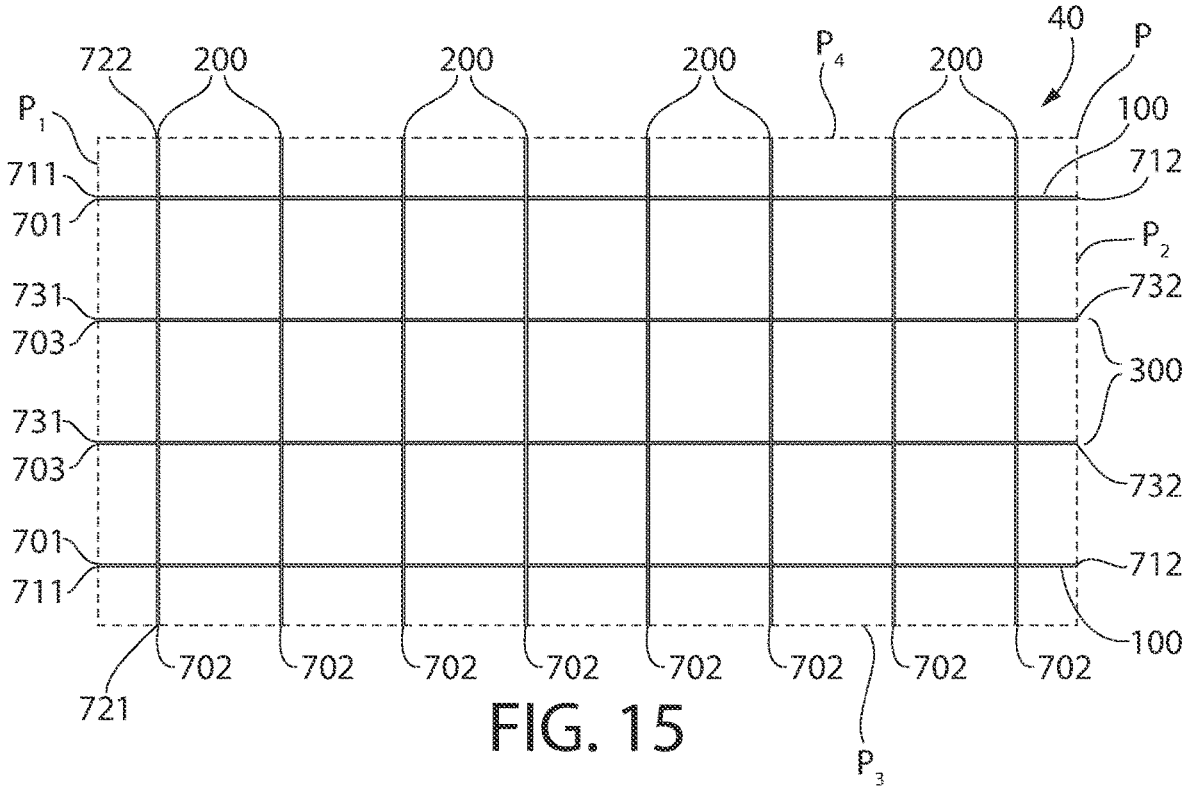
FIG. 15 is a plan view of the first ceiling system kit of FIG. 14 in an assembled state.

It should be noted that not all of the panels 100, 200, 300 need to have the same length. Indeed, in the kit 40, the bottom and top panels 100, 300 are of a first axial length $L_1$ and the middle panels are of a shorter second axial length $L_2$. Different lengths may be selected depending on the desired size of the assembled ceiling system. As shown in FIG. 15, the kit 40 results in a ceiling system having a 4 foot width and an 8 foot length. The assembly of the kit 40 will be discussed in greater detail with respect to FIG. 15. Hanging hardware 30 attaches exclusively to the bottom panels 100 as discussed above. The middle and top panels 200, 300 are free of hanging hardware 30. The hanging hardware 30 also attaches to the support structure 20 of the building 2 as discussed above.

FIG. 15 shows an assembled kit 40 having bottom, middle, and top panels 100, 200, 300 as shown. The plurality of bottom panels 100 are arranged in a non-intersecting arrangement with respect to one another, each bottom panel 100 forming its own bottom panel row 701. In the kit 40, each bottom panel row 701 comprises only a single bottom panel 100, but in other embodiments, more than one bottom panel 100 may form each bottom panel row 701. Furthermore, each bottom panel 100 in each of the bottom panel rows 701 need not be identical. Each bottom panel 100 in each of the bottom panel rows 701 may differ in length or other characteristics.

Each of the middle panels 200 are assembled with the plurality of bottom panels 100 in an intersecting arrangement as discussed above. Each of the middle panels 200 lies in a middle panel row 702. Each of the middle panel rows 702 intersects with each of the bottom panel rows 701. In the kit 40, only one middle panel 200 forms each middle panel row 702. In other embodiments, more than one middle panel 200 may form each middle panel row 702. Furthermore, each middle panel 200 in each of the middle panel rows 702 need not be identical. Each middle panel 200 in each of the middle panel rows 702 may differ in length or other characteristics.

Each of the top panels 300 are assembled with the plurality of middle panels 200 in an intersecting arrangement as discussed above. Each of the top panels 300 lies in a top panel row 703, each of the top panel rows 703 intersecting with each of the middle panel rows 702. Each of the top panel rows 703 is substantially parallel and non-intersecting with each of the bottom panel rows 701. In the kit 40, only one top panel 300 forms each top panel row 703. In other embodiments, more than one top panel 300 may form each top panel row 703. Furthermore, each top panel 300 in each of the top panel rows 703 need not be identical. Each top panel 300 in each of the top panel rows 703 may differ in length or other characteristics.

The kit 40 has a perimeter P comprising a plurality of planes. A plurality of left side edges 711, 731 of certain ones of the bottom panels 100 and top panels 300 lie in a first plane $P_1$. A plurality of right side edges 712, 732 of certain ones of the bottom panels 100 and top panels 300 lie in an opposite second plane $P_2$. Where the bottom panel rows 701 and top panel rows 703 each comprise a plurality of bottom panels 100 and top panels 300, not all left and right side edges 711, 731, 712, 732 may lie in the first and second planes $P_1$, $P_2$. Instead, the left side edges 711, 731 of a first portion of the bottom panels 100 and top panels 300 may lie in the first plane $P_1$ while the right side edges 712, 732 of a second portion of the bottom panels 100 and top panels 300 may lie in the second plane $P_2$.

Furthermore, a plurality of front side edges 721 of the middle panels 200 lie in the front plane $P_3$ while a plurality of rear side edges 722 of the middle panels 200 lie in the opposite rear plane $P_4$. As before, not all of the front side edges 721 of the middle panels 200 need lie in the front plane $P_3$ and not all of the rear side edge 722 of the middle panels 200 need lie in the rear plane $P_4$. Instead, only a portion of the front and rear side edges 721, 722 of the middle panels 200 need lie in each of the front and rear planes $P_3$, $P_4$ in the event that there is more than one middle panel 200 in some or all of the middle panel rows 702.

Figure 16:
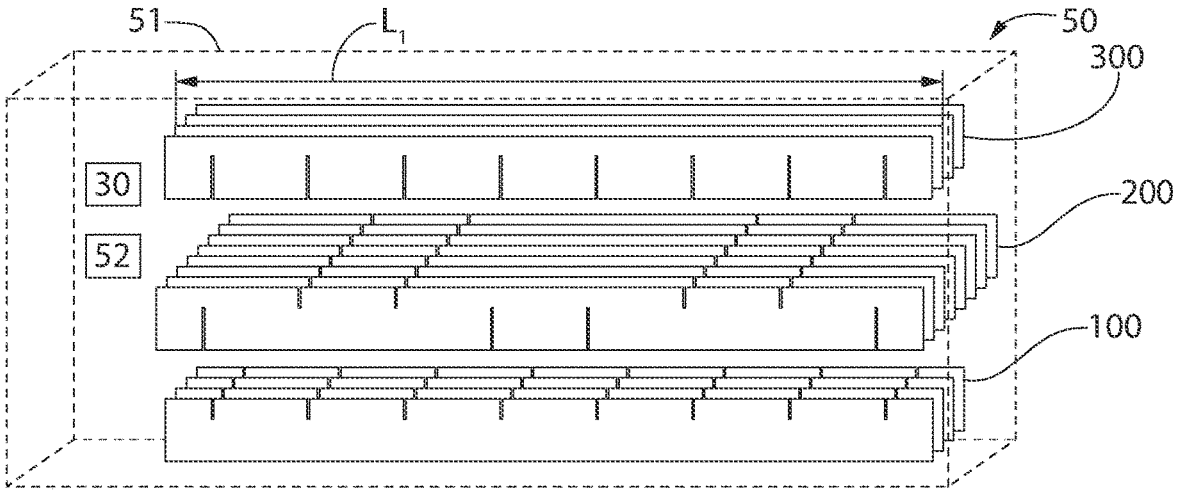
FIG. 16 is a representation of a second ceiling system kit of the ceiling system of FIG. 1.
Figure 17:
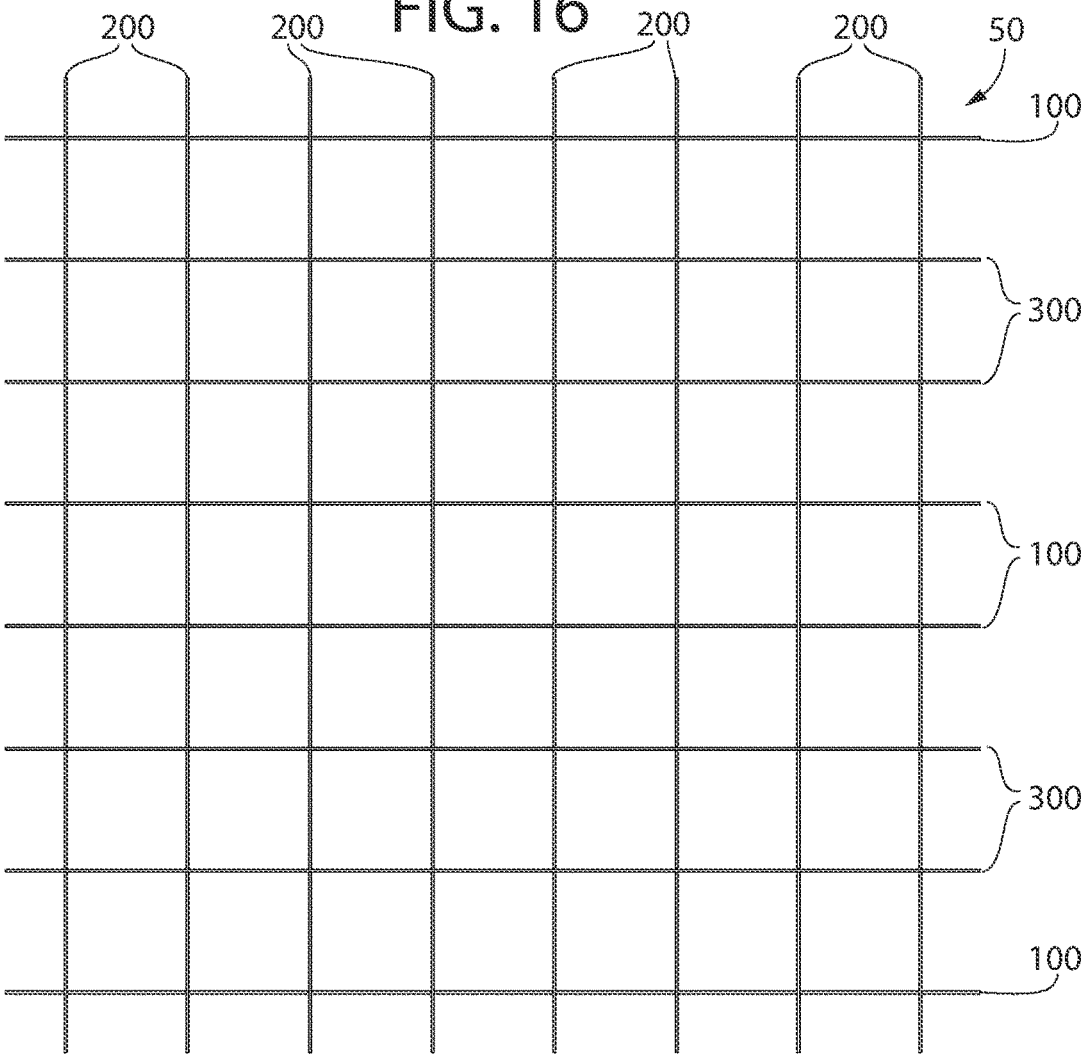
FIG. 17 is a plan view of the second ceiling system kit of FIG. 14 in an assembled state.

Turning to FIGS. 16 and 17, a second ceiling system kit 50 is shown comprising a plurality of bottom, middle, and top panels 100, 200, 300. The kit 50 also comprises hanging hardware 30, instructions 52, and a package 51 analogous to the package 41 discussed above. Each of the panels 100, 200, 300 has a first axial length $L_1$. As can be seen in FIG. 17, the kit 50 is assembled into a square open cell grid structure of equal width and length. In this embodiment, the kit 50 forms an 8 foot by 8 foot structure. As illustrated, the bottom panels 100 are non-intersecting and substantially parallel. The middle panels 200 intersect the bottom panels 100 and are substantially perpendicular to the bottom panels 100. The top panels 300 are non-intersecting with other ones of the top panels 300 and with the bottom panels 100, but are substantially perpendicular to the middle panels 200. The panels 100, 200, 300 are assembled as discussed above, with the bottom panels 100 being attached to the hanging hardware 30 and the middle panels 200 resting on the bottom panels 100. Furthermore, the top panels 300 rest on the middle panels 200. Each of the middle and top panels 200, 300 are free of hanging hardware 30. As with the kit 40, each of the panels 100, 200, 300 lies in a respective bottom, middle, and top row. Each of these rows comprise only a single panel in this embodiment. Furthermore, the perimeter is defined by a plurality of planes in the same manner as the kit 40. The ends of the panels 100, 200, 300 lie in the plurality of planes as discussed above with respect to FIGS. 14 and 15.

Figure 18:
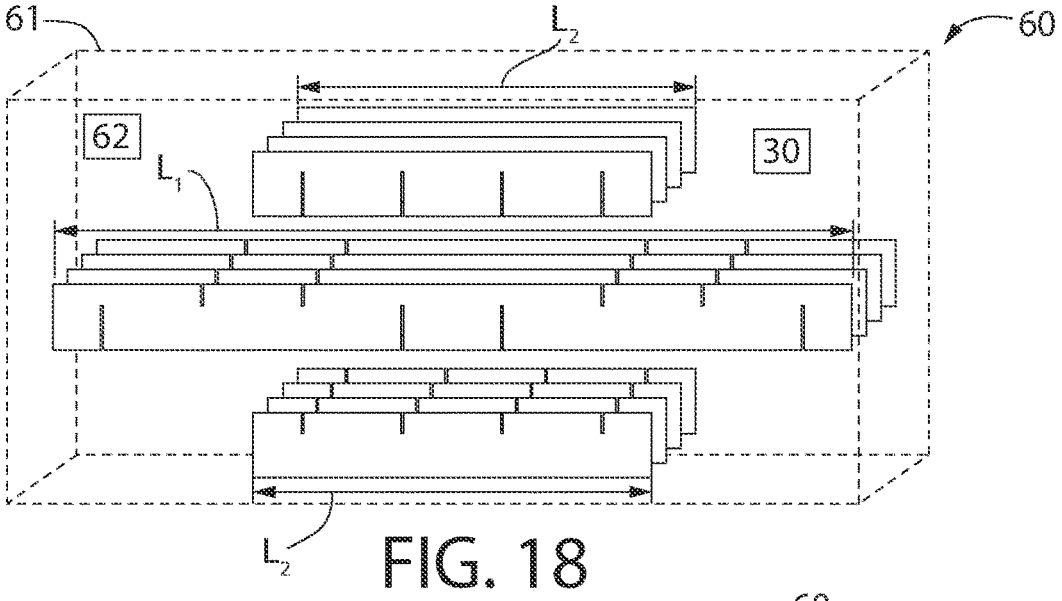
FIG. 18 is a representation of a third ceiling system kit of the ceiling system of FIG. 1.
Figure 19:
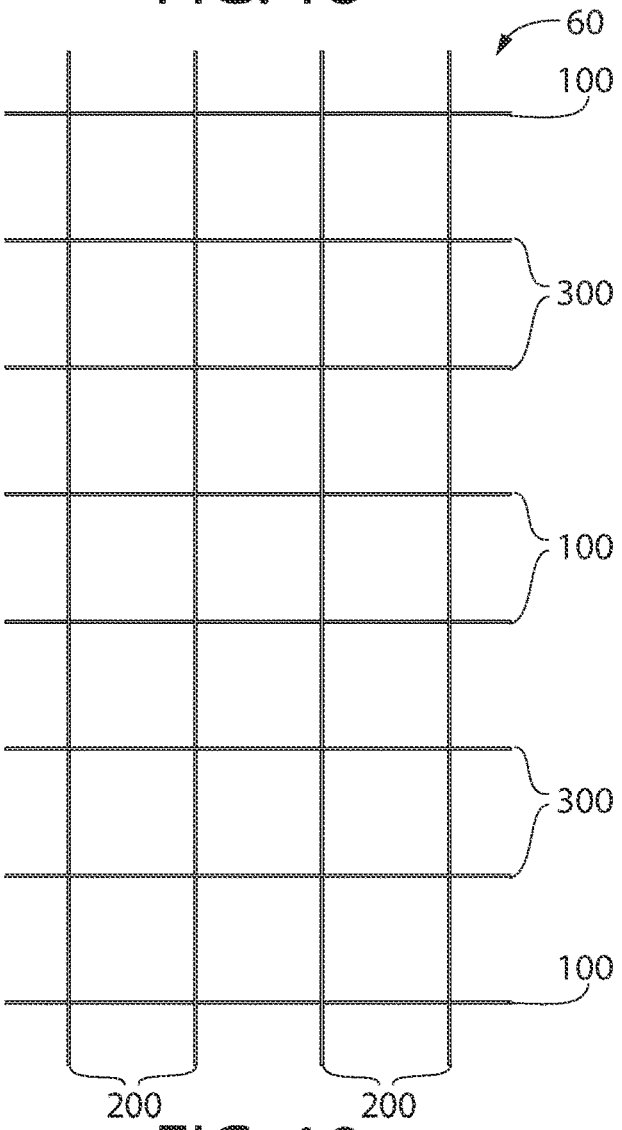
FIG. 19 is a plan view of the third ceiling system kit of FIG. 14 in an assembled state.

Turning to FIGS. 18 and 19, a third ceiling system kit 60 is shown. The kit 60 comprises a plurality of bottom, middle, and top panels 100, 200, 300. The kit 60 also comprises hanging hardware 30, instructions 62, and a package 61 analogous to the package 41 discussed above. Each of the bottom and top panels 100, 300 has a second axial length $L_2$ and each of the middle panels has a first axial length $L_1$. The second axial length $L_2$ is less than the first axial length $L_1$. The panels 100, 200, 300 are assembled as discussed above, with the bottom panels 100 being attached to the hanging hardware 30 and the middle panels 200 resting on the bottom panels 100. Furthermore, the top panels 300 rest on the middle panels 200. Each of the middle and top panels 200, 300 are free of hanging hardware 30. As can be seen, the bottom and top panels 100, 300 can be shorter than the middle panels 200. In the kit 60, an 8 foot wide by 4 foot long system is assembled. Alternately, the middle panels 200 can be shorter than the bottom and top panels 100, 300 as shown in the kit 40. Thus, a variety of axial lengths can be used to assemble a variety of different sized open cell grid systems, depending on the requirements of the space.

Figure 20:
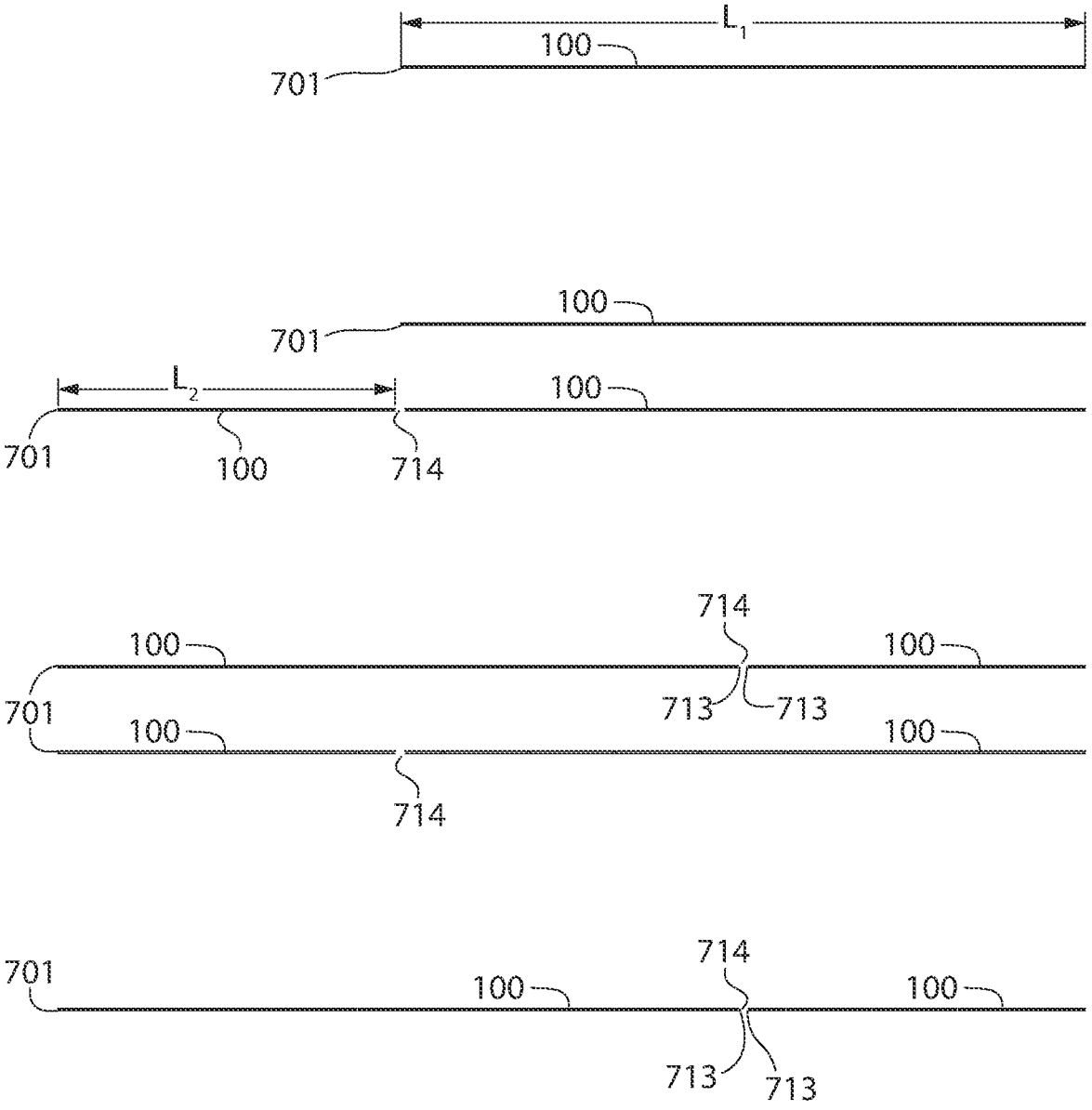
FIG. 20 is a plan view of the bottom panels of the ceiling system in a first embodiment during a first assembly step.
Figure 21:
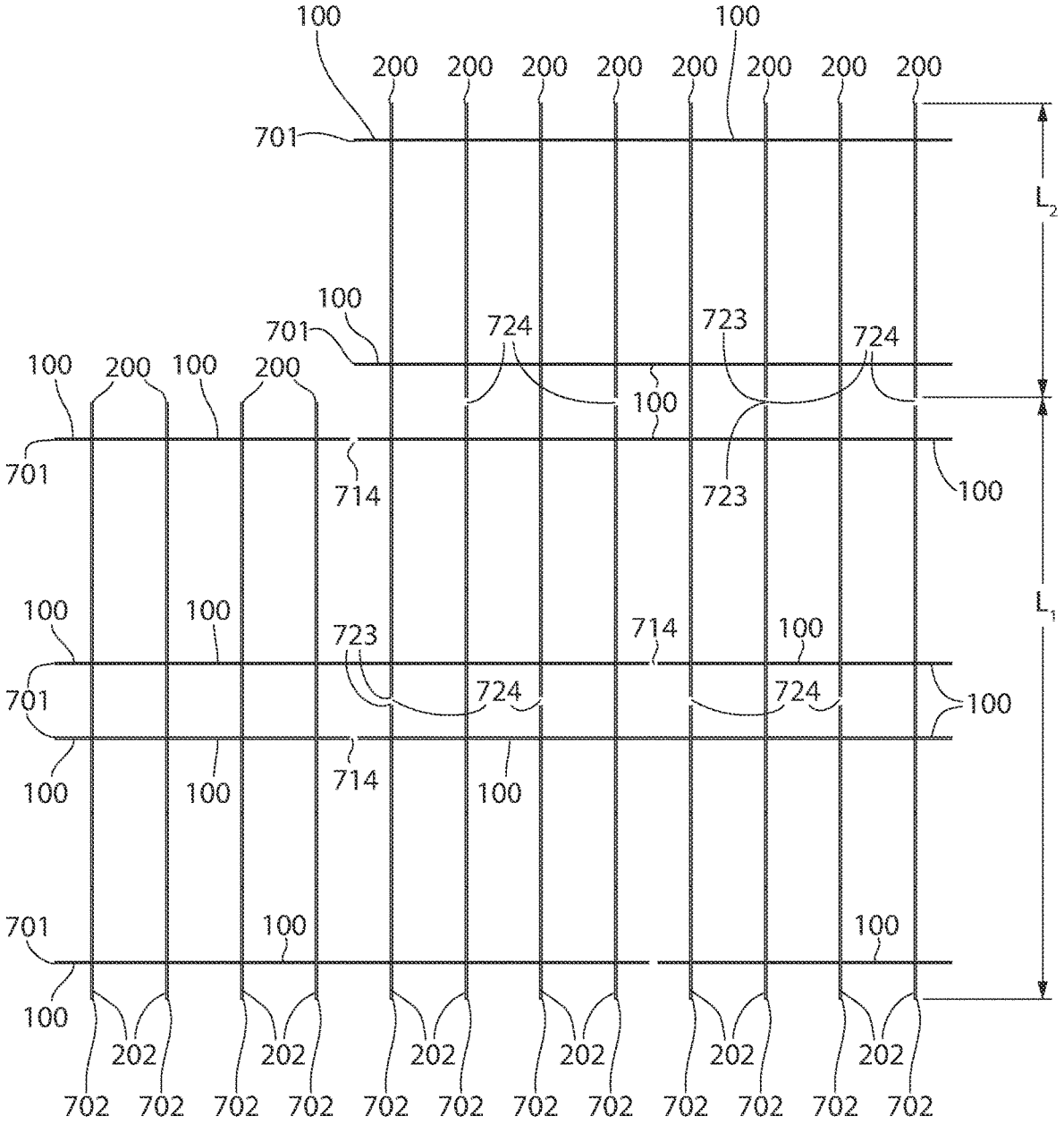
FIG. 21 is a plan view of the bottom and middle panels of the ceiling system of the first embodiment during a second assembly step.
Figure 22:
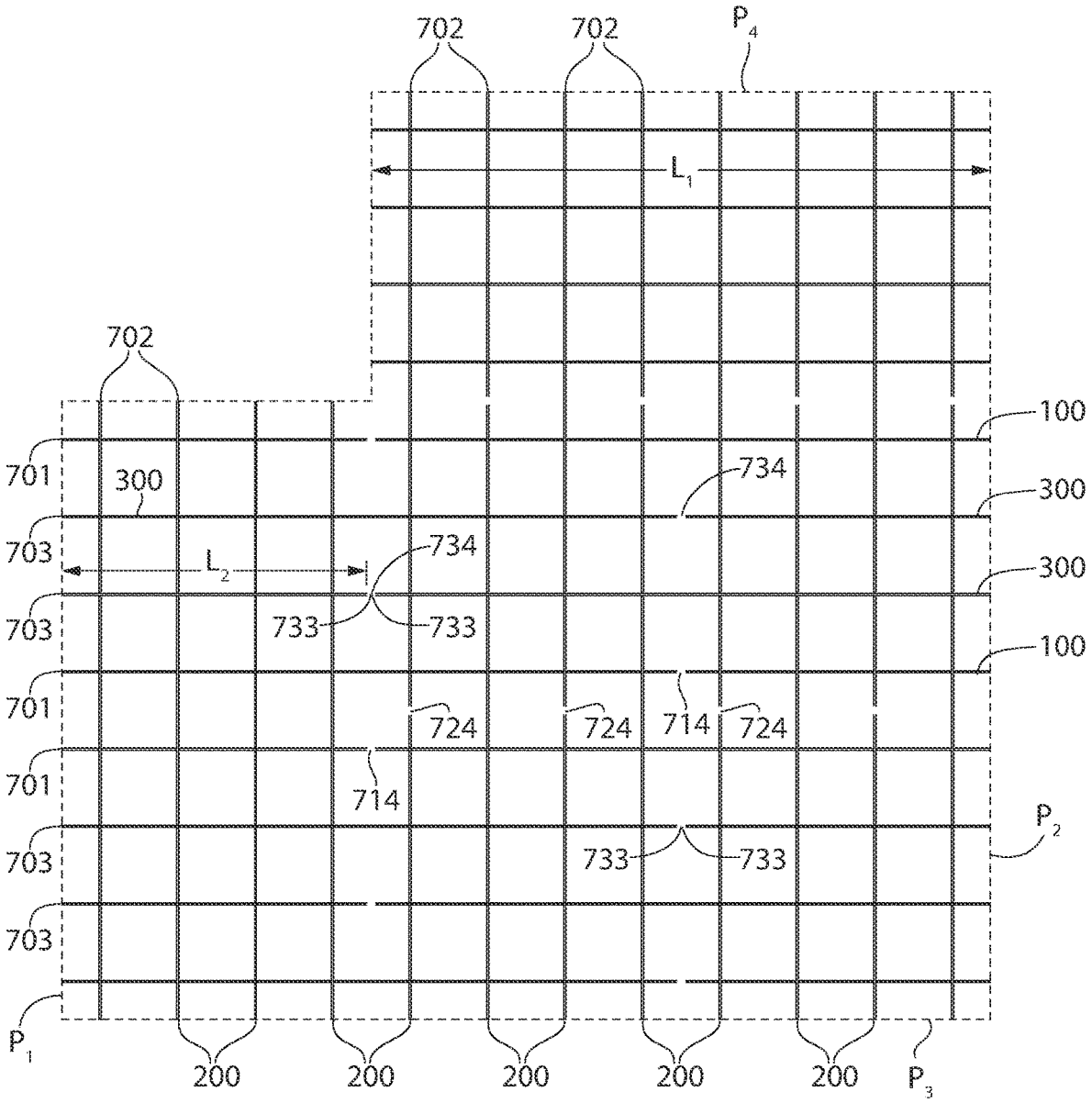
FIG. 22 is a plan view of the bottom, middle, and top panels of the ceiling system of the first embodiment during a third assembly step.

Turning to FIGS. 20-22, a first embodiment is shown employing a plurality of kits of different types to provide an installation which is non-rectangular. Furthermore, the component kits of this embodiment are interconnected such that the system is one cohesive installation rather than a plurality of separate systems which are free to move independently from each other. As best shown in FIG. 22, the resulting system is 12 feet wide by 12 feet long and arranged in an "L" shape. This embodiment is constructed using one of each of the kits 40, 50, 60 discussed above.

In a first installation step shown in FIG. 20, the plurality of bottom panels 100 are assembled into bottom panel rows 701, with each of the plurality of bottom panels 100 secured to the support structure 20 of the building 2 via hanging hardware 30 (not shown). Each of the bottom panel rows 701 are substantially parallel and non-intersecting. As can be seen, a first portion of the bottom panel rows 701 have a plurality of bottom panels 100 while a second portion of the bottom panel rows 701 have only a single bottom panel 100 therein. The bottom panels 100 comprise a first plurality of bottom panels 100 having an axial length $L_1$ and a second plurality of bottom panels 100 having an axial length $L_2$ that is less than the first axial length $L_1$. As can be seen, some of the bottom panels 100 are axially aligned. A plurality of bottom gaps 714 are formed where the side edges 713 of two bottom panels 100 meet in an individual bottom panel row 701. It should be noted that no two adjacent bottom panel rows 701 has a pair of transversely adjacent bottom gaps 714 with respect to the bottom panel rows 701. Instead, the bottom panels 100 of different lengths are arranged such that the bottom gaps 714 are always separated from each other in the direction of the bottom panel rows 701. Thus, no two bottom gaps 714 are adjacent in a direction perpendicular to the bottom panel rows 701. This serves to ensure that the bottom panels 100 are interleaved such that they form a single system rather than individual separate systems. This ensures that the visual appearance of the resulting open cell grid structure is integral, without the appearance of separate structures simply mounted adjacent to one another. This improves the resulting aesthetic appearance as well as improving the strength and rigidity of the resulting installation.

In a second installation step shown in FIG. 21, the plurality of bottom panels 100 are assembled with a plurality of middle panels 200 in a plurality of middle panel rows 702 as shown. The plurality of middle panels 200 are of first and second lengths $L_1$, $L_2$. The middle panels 200 are arranged such that those middle panel rows 702 having a plurality of middle panels 200 which are axially aligned. A middle gap 724 is formed where adjacent side edges 723 of the plurality of middle panels 200 meet within a middle panel row 702. Each of the middle gaps 724 are arranged such that there are no transversely adjacent middle gaps 724 along the direction of the middle panel rows 702. Thus, no two middle gaps 724 are adjacent in a direction perpendicular to the middle panel rows 702. This helps to tie the resulting open cell grid structure together as discussed above.

In a third installation step shown in FIG. 22, the plurality of bottom panels 100 and middle panels 200 are assembled with a plurality of top panels 300 in a plurality of top panel rows 703 as shown. Some of the top panels 300 have a first axial length $L_1$ while other ones of the top panels 300 has a second axial length $L_2$ which is shorter than the first axial length $L_1$. Some of the top panel rows 703 have a plurality of top panels 300 therein, these plurality of top panels 300 being axially aligned. In contrast, other ones of the top panel rows 703 have only a single top panel 300 therein. In those top panel rows 703 having a plurality of top panels 300 therein, there is a top gap 734 where adjacent side edges 733 meet. The top panels 300 are assembled such that no adjacent top panel rows 703 or bottom panel rows 701 have a top gap 734 or bottom gap 714 transversely adjacent any other top gap 734 or bottom gap 714 in the direction of the top panel rows 703. Thus, no two top or bottom gaps 734, 714 are adjacent in a direction perpendicular to the top panel rows 703. Although some of the top and bottom gaps 734, 714 may be adjacent middle gaps 724, this has no negative effect on the strength or rigidity of the resulting assembly because these gaps are perpendicular to one another. In this manner, a variety of different kits can be combined to create an open cell grid structure of virtually any shape or size.

As can be seen, a first plane $P_1$ is defined by the left edges of a portion of the top and bottom panels 300, 100. A second plane $P_2$ is defined by the right edges of a portion of the top and bottom panels 300, 100. A third plane $P_3$ is defined by the front edges of a portion of the middle panels 200. A fourth plane $P_4$ is defined by the rear edges of a portion of the middle panels 200. The first and second planes $P_1$, $P_2$ are perpendicular to the bottom panel rows 701 and the top panel rows 703. The third and fourth planes $P_3$, $P_4$ are perpendicular to the middle panel rows 702.

Where the user intends to install a system which is a combination of a plurality of kits, instructions for the individual kits are supplemented with instructions for how to mate panels from a first kit and a second kit in order to create the combined open cell grid structure. In these instructions, the arrangement of the bottom, middle, and top panels 100, 200, 300 is disclosed so as to prevent any edge to edge interfaces or edge to edge gaps opposing each other or otherwise being adjacent in a transverse direction to the respective panel row. An edge to edge interface is defined as when two panels are in contact and an edge to edge gap is defined as when two panels are spaced from each other. The instructions may further comprise information regarding using the hanging hardware 30 of the first kit and the second kit together. The instructions may be provided as instruction sheets, an instruction manual, a representation on the product packaging, or in electronic format such as a PDF or a website, with the packaging comprising a link or other reference to the website.

Figure 23:
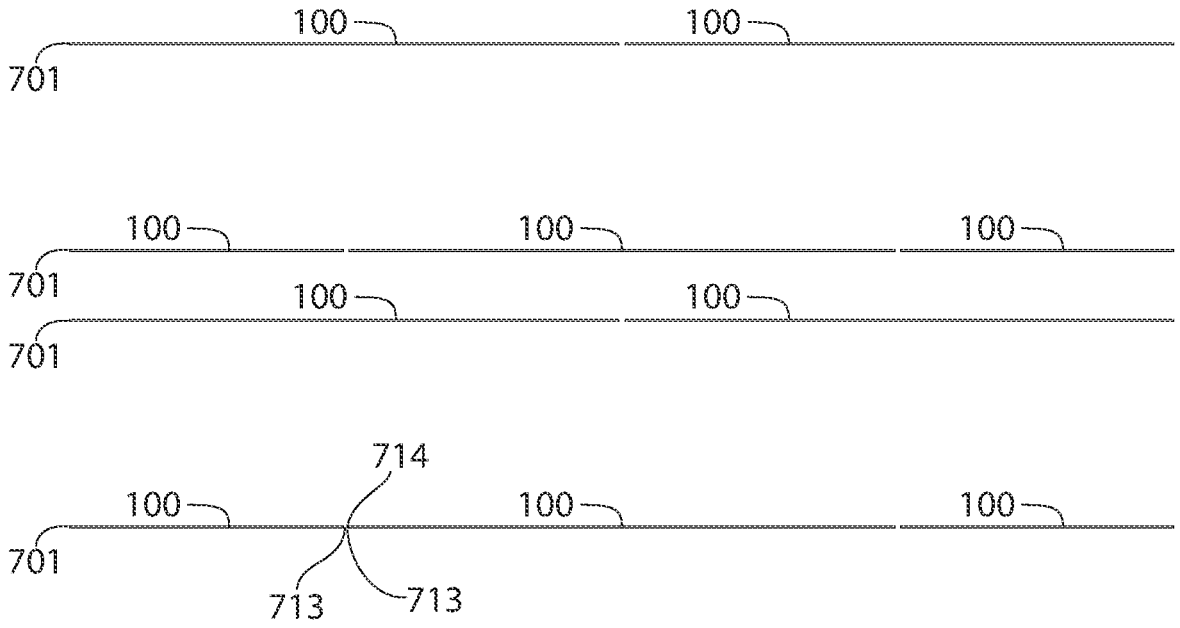
FIG. 23 is a plan view of the bottom panels of the ceiling system of a second embodiment during a first assembly step.
Figure 24:
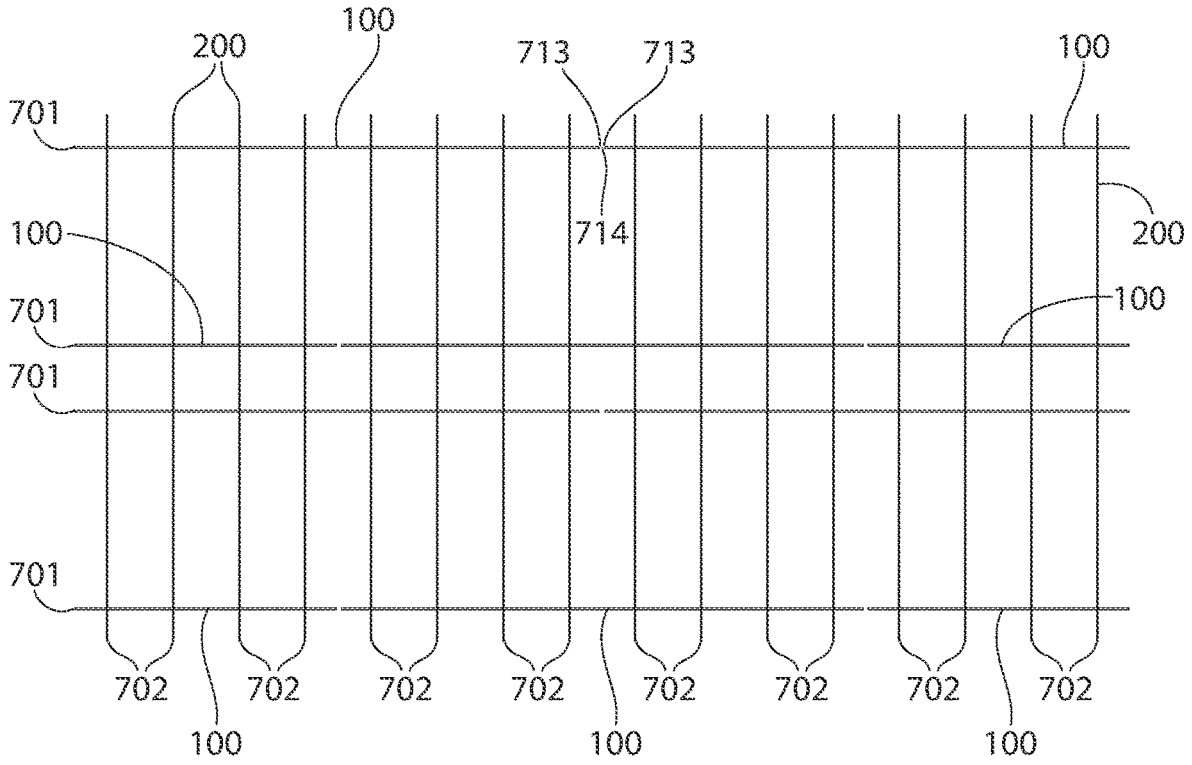
FIG. 24 is a plan view of the bottom and middle panels of the ceiling system of the second embodiment during a second assembly step.
Figure 25:
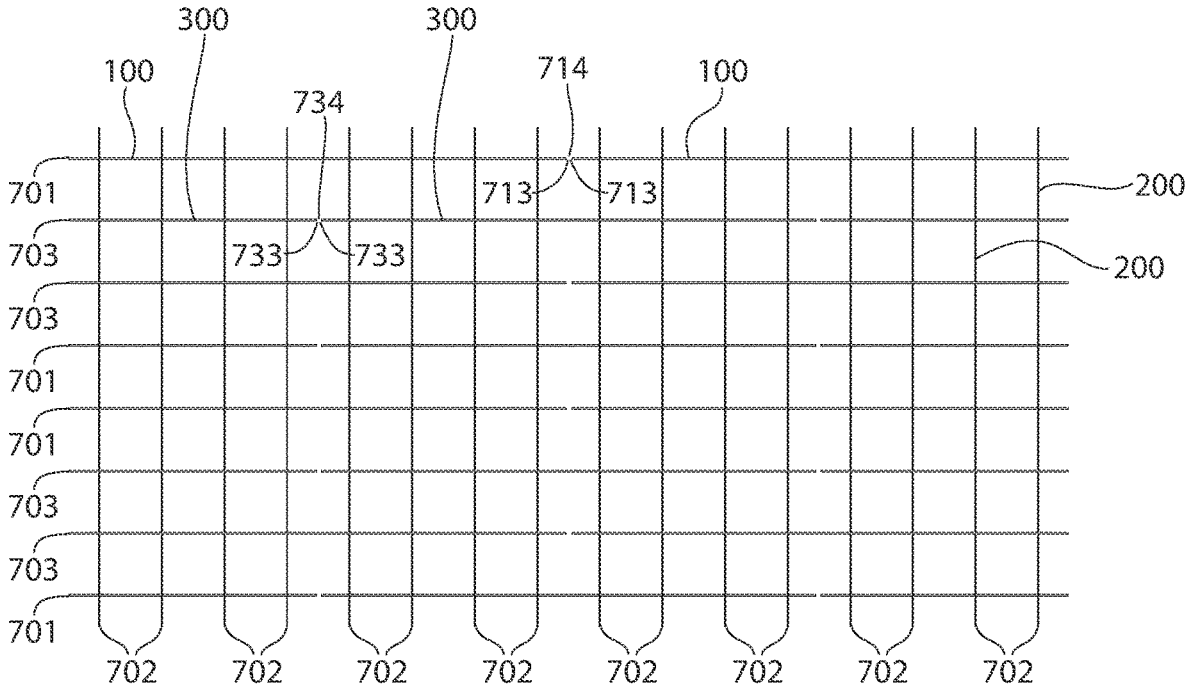
FIG. 25 is a plan view of the bottom, middle, and top panels of the ceiling system of the second embodiment during a third assembly step.

Turning to FIGS. 23-25, two of the 8 foot by 8 foot kits 50 are assembled to form an 8 foot wide by 16 foot long open cell grid structure. In the first step shown in FIG. 23, the bottom panels 100 are assembled as shown. Instead of utilizing two different kits, it is possible to utilize two of the same kit and cut two of the bottom panels 100 in half, rearranging the halves to ensure that the bottom gaps 714 are alternating as shown. This reduces the number of different kits which must be stocked and allows the installer to field-modify the panels to complete an installation with fewer components. Thus, the bottom panel rows 701 each have a plurality of bottom panels 100, some of which are cut from longer bottom panels 100 as shown.

In the second step shown in FIG. 24, the middle panels 200 are assembled to the bottom panels 100 as shown. Each of the middle panels 200 has the same length and none of the middle panels 200 needs to be cut to facilitate installation. Due to the use of a single middle panel 200 in each middle panel row 702, there are no middle gaps 724.

In the third step shown in FIG. 25, the top panels 300 are assembled to the middle panels 200 as shown. A portion of the top panels 300 must be cut to provide top panels 300 of two different lengths as shown. The top gaps 734 are transversely separated from each and every other top gap 734 and bottom gap 714 as discussed above. Although it is possible to utilize top panels 300 of identical length without cutting them, this would result in transversely adjacent top gaps 734. This would reduce the strength and rigidity of the system, so it is an undesirable configuration. It is also possible to supply top panels 300 and bottom panels 100 in differing lengths to permit assembly without the need to cut the top and bottom panels 300, 100.

While the foregoing description and drawings represent exemplary embodiments of the present disclosure, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes described herein may be made within the scope of the present disclosure. One skilled in the art will further appreciate that the embodiments may be used with many modifications of structure, arrangement, proportions, sizes, materials, and components and otherwise, used in the practice of the disclosure, which are particularly adapted to specific environments and operative requirements without departing from the principles described herein. The presently disclosed embodiments are therefore to be considered in all respects as illustrative and not restrictive. The appended claims should be construed broadly, to include other variants and embodiments of the disclosure, which may be made by those skilled in the art without departing from the scope and range of equivalents. In addition, all combinations of any and all of the features described in the disclosure, in any combination, are part of the invention.

Exemplary Claim Set

Exemplary claim 1. A ceiling system comprising: an open cell grid structure comprising: a plurality of bottom panel rows arranged in a non-intersecting arrangement with respect to one another, each of the plurality of bottom panel rows comprising first and second bottom panels of different axial lengths arranged in axial alignment with one another so that a bottom gap exists between adjacent side edges of the first and second bottom panels, each of the first and second bottom panels having a downwardly facing bottom edge and an upwardly facing top edge, and wherein the bottom gaps of transversely adjacent ones of the plurality of bottom panel rows are offset from one another in an axial direction of the bottom panel rows; a plurality of middle panel rows mounted to the bottom panel rows in a first intersecting arrangement with the plurality of bottom panel rows, each of the middle panel rows comprising at least one middle panel having a downwardly facing bottom edge and an upwardly facing top edge; and a plurality of top panel rows mounted to the middle panel rows in a second intersecting arrangement with the middle panel rows and a non-intersecting arrangement with the bottom panel rows, each of the top panel rows comprising at least one top panel having a downwardly facing bottom edge and an upwardly facing top edge; and hanging hardware connected to each one of the first panel rows and to a support structure to hang the open cell grid structure from the support structure in an occupied space of a building.

Exemplary claim 2. The ceiling system according to claim 1 wherein each of the top panel rows comprises first and second top panels of different axial lengths arranged in axial alignment with one another so that a top gap exists between adjacent side edges of the first and second top panels, and wherein the top gaps of transversely adjacent ones of the top panel rows are offset from one another in an axial direction of the top panel rows.

Exemplary claim 3. The ceiling system according to claim 2 wherein the top and bottom panel rows are substantially parallel to one another; and wherein the top and bottom gaps of all transversely adjacent top and bottom panel rows are offset from one another in the axial directions of the top and bottom panel rows.

Exemplary claim 4. The ceiling system according to any one of claims 2 to 3 further comprising: the first bottom panel and the first top panel having a first axial length; and the second bottom panel and the second top panel having a second axial length that is less than the first axial length.

Exemplary claim 5. The ceiling system according to claim 4 wherein along a first side of a perimeter of the open cell grid structure, left side edges of certain ones of the first bottom panels, the first top panels, the second bottom panels, and the second top panels are aligned with one another along a first plane; and wherein along a second side of the perimeter of the open cell grid structure that is opposite the first side, right side edges of other ones of the first bottom panels, the first top panels, the second bottom panels, and the second top panels are aligned with one another along a second plane.

Exemplary claim 6. The ceiling system according to any one of claims 1 to 5 wherein each of the middle panel rows comprises first and second middle panels of different axial lengths arranged in axial alignment with one another so that a middle gap exists between adjacent side edges of the first and second middle panels, and wherein the middle gaps of transversely adjacent ones of the top panel rows are offset from one another in the axial direction.

Exemplary claim 7. The ceiling system according to any one of claims 1 to 6 further comprising: each of the first and second bottom panels having a plurality of upper slots in the top edge of the first and second top panels; each of the middle panels having a plurality of upper slots in the top edge of the middle panel and a plurality of lower slots in the bottom edge of the middle panel that are offset from the upper slots of the middle panel, the middle panel rows mounted to the bottom panel rows in the first intersecting arrangement so that the lower slots of the middle panels mate with the upper slots of the bottom panels to form primary intersection nodes; and each of the top panels having a plurality of lower slots in the bottom edge of the top panel, the top panel rows mounted to the middle panel rows in the second intersecting arrangement so that the lower slots of the top panels mate with the upper slots of the middle panels at secondary intersection nodes.

Exemplary claim 8. The ceiling system according to claim 7 wherein the middle panels are supported in the open cell grid structure solely due to the mating between the middle panels and the first and second bottom panels at the primary intersection nodes; and wherein the top panels are supported in the open cell grid structure solely due to the mating between the middle and top panels at the secondary intersection nodes.

Exemplary claim 9. The ceiling system according to any one of claims 7 to 8 wherein the bottom edges of the middle panels and the first and second bottom panels are substantially flush with one another at the primary intersection nodes and the bottom edges of the middle panels and the top panels are substantially flush with one another at the secondary intersection nodes.

Exemplary claim 10. A method of installing a ceiling system comprising: a) providing a first ceiling system kit comprising: (i) a plurality of first kit panels configured to mate with one another to form a first open cell grid structure when assembled; and (ii) first hanging hardware for hanging the first open cell grid structure; b) providing a second ceiling system kit comprising: (i) a plurality of second kit panels configured to mate with one another to form a second open cell grid structure when assembled; and (ii) second hanging hardware for hanging the second open cell grid structure; c) providing instructions how to mate the first and second kit panels to form a combined open cell grid structure in which no complete cell of the combined open cell grid structure has edge-to-edge interfaces or edge-to-edge gaps that oppose one another; and d) building the combined open cell grid structure using the first and second ceiling system kits in accordance with the instructions in an occupied space of a building in which the combined open cell grid structure is hung from a support structure by the first and second hanging hardware.

Exemplary claim 11. The method according to claim 10 further comprising: the plurality of first kit panels comprising: a plurality of first bottom panel panels having a first axial length; a plurality of first middle panels having the first axial length; and a plurality of first top panels having the first axial length; and the plurality of second kit panels comprising: a plurality of second bottom panel panels having a second axial length that is less than the first axial length; a plurality of second middle panels having the first axial length; and a plurality of second top panels having the second axial length.

Exemplary claim 12. The method according to claim 11 wherein step d comprises: d-1) hanging the first bottom panels and the second bottom panels from the support structure using the first and second hanging hardware in a plurality of bottom panel rows, each of the bottom panel rows comprising one of the first bottom panels and one of the second bottom panels arranged in axial alignment with one another so that a bottom edge-to-edge gap exists between adjacent side edges of the first and second bottom panels, and wherein the bottom edge-to-edge gaps of transversely adjacent ones of the bottom panel rows are offset from one another in an axial direction of the bottom panel rows; d-2) mounting the first and second middle panels to the bottom panel rows in a first intersecting arrangement with the bottom panel rows to form a plurality of middle panel rows; and d-3) mounting the first and second top panels to the middle panel rows in a second intersecting arrangement with the middle panel rows and a non-intersecting arrangement with the bottom panel rows to form a plurality of middle panel rows, each of the top panel rows comprising one of the first top panels and one of the second top panels arranged in axial alignment with one another so that a top edge-to-edge gap exists between adjacent side edges of the first and second top panels, and wherein the top edge-to-edge gaps of transversely adjacent ones of the top panel rows are offset from one another in an axial direction of the top panel rows.

Exemplary claim 13. The method according to claim 12 wherein step d-1) comprises: d-1-1) forming a first one of the bottom panel rows by hanging one of the first bottom panels and one of the second bottom panels in axial alignment, a left side edge of the one of the first bottom panels located within a plane that perpendicular to an axial direction of the first one of the bottom panel rows; and d-1-2) forming a second one of the bottom panel rows by hanging another one of the first bottom panels and another one of the second bottom panels in axial alignment, a left side edge of the another one of the second bottom panels located within the plane.

Exemplary claim 14. The method according to claim 13 wherein step d-3) comprises: d-3-1) forming a first one of the top panel rows by mounting one of the first top panels and one of the second top panels to the middle panel rows in axial alignment, a left side edge of the one of the first top panels located within the plane; and d-3-2) forming a second one of the top panel rows by hanging another one of the first top panels and another one of the second top panels in axial alignment, a left side edge of the another one of the second top panels locate within the plane.

Exemplary claim 15. The method according to any one of claims 12 to 14 further comprising: wherein step d-2) comprises mounting the first and second middle panels to the bottom panel rows by mating lower slots of the first and second middle panels with upper slots of the first bottom panels and the second bottom panels to form primary intersection nodes; and wherein step d-3) comprises mounting the first and second top panels to the middle panel rows by mating lower slots of the first and second top panels with the upper slots of the first and second middle panels to form secondary intersection nodes.

Exemplary claim 16. The method according to any one of claims 12 to 15 wherein at least one of the first or second middle panels mates with both the one of the first bottom panels and the one of the second bottom panels.

Exemplary claim 17. The method according to any one of claims 12 to 16 wherein the middle panel rows are supported in the combined open cell grid structure solely due to mating between the first and second middle panels and the first and second bottom panels; and wherein the top panel rows are supported in the open cell grid structure solely due to the mating between the first and second middle panels and the first and second top panels at the secondary intersection nodes.

Exemplary claim 18. A method of installing a ceiling system comprising: a) hanging, from a support structure, a plurality of bottom panel rows in a non-intersecting arrangement with one another using hanging hardware, each of the bottom panel rows comprising a first bottom panel and a second bottom panel of different axial lengths arranged in axial alignment with one another, wherein the first and second bottom panels of adjacent rows of the bottom panel rows are staggered with one another; b) mounting a plurality of middle panel rows to the bottom panel rows in a first intersecting arrangement with the bottom panel rows; and c) mounting a plurality of top panel rows to the middle panel rows in a second intersecting arrangement with the middle panel rows and a non-intersecting arrangement with the bottom panel rows, each of the top panel rows comprising a first top panel and a second top panel of different axial lengths arranged in axial alignment with one another, wherein the first and second top panels of adjacent rows of the top panel rows are staggered with one another, thereby forming an open cell grid structure.

Exemplary claim 19. The method according to claim 18 wherein the middle panel rows are supported in the open cell grid structure solely due to mating between the middle panels and the first and second bottom panels; and wherein the top panel rows are supported in the open cell grid structure solely due to the mating between the first and second top panels and the middle panels at the secondary intersection nodes.

Exemplary claim 20. The method according to any one of claims 18 to 19 wherein one of the middle panels mates with both of at least one of the first bottom panels and at least one of the second bottom panels.

Exemplary claim 21. A method of installing a ceiling system comprising: a) providing a first ceiling system kit comprising: (i) a plurality of first kit panels configured to mate with one another to form a first open cell grid structure having an A×B completed cell grid when assembled; and (ii) first hanging hardware for hanging the first open cell grid structure; b) providing a second ceiling system kit comprising: (i) a plurality of second kit panels configured to mate with one another to form a second open cell grid structure having an X×B completed cell grid when assembled; and (ii) second hanging hardware for hanging the second open cell grid structure; c) providing instructions how to mate the first and second kit panels to form a combined open cell grid structure having an A+X+1×B completed cell grid portion when assembled in which: (i) at least one of the first kit panels has a left side edge that forms a portion of a first side of a perimeter of the combined open cell grid structure; and (ii) at least one of the first kit panels has a right side edge that forms a portion of a second side of the perimeter of the combined open cell grid structure opposite the first side; and d) building the combined open cell grid structure using the first and second ceiling system kits in accordance with the instructions in an occupied space of a building in which the combined open cell grid structure is hung from a support structure by the first and second hanging hardware.

What is claimed is:

1. A ceiling system comprising:

an open cell grid structure comprising:

a plurality of bottom panels defining a plurality of bottom panel rows arranged in a non-intersecting arrangement with respect to one another, each of the plurality of bottom panel rows comprising first and second bottom panels of different axial lengths arranged in axial alignment with one another so that a bottom gap exists between adjacent side edges of the first and second bottom panels, each of the first and second bottom panels having a downwardly facing bottom edge and an upwardly facing top edge, and wherein the bottom gaps of transversely adjacent ones of the plurality of bottom panel rows are offset from one another in an axial direction of the bottom panel rows;

a plurality of middle panel rows mounted to the bottom panel rows in a first intersecting arrangement with the plurality of bottom panel rows, each of the middle panel rows comprising at least one middle panel having a downwardly facing bottom edge and an upwardly facing top edge; and a plurality of top panel rows mounted to the middle panel rows in a second intersecting arrangement with the middle panel rows and a non-intersecting arrangement with the bottom panel rows, each of the top panel rows comprising at least one top panel having a downwardly facing bottom edge and an upwardly facing top edge; and hanging hardware connected to each one of the bottom panels and configured for connection to a support structure to hang the open cell grid structure from the support structure in an occupied space of a building.

2. The ceiling system according to claim 1 wherein each of the top panel rows comprises first and second top panels of different axial lengths arranged in axial alignment with one another so that a top gap exists between adjacent side edges of the first and second top panels, and wherein the top gaps of transversely adjacent ones of the top panel rows are offset from one another in an axial direction of the top panel rows.

3. The ceiling system according to claim 2 wherein the top and bottom panel rows are substantially parallel to one another; and wherein the top and bottom gaps of all transversely adjacent top and bottom panel rows are offset from one another in the axial directions of the top and bottom panel rows.

4. The ceiling system according to claim 2 further comprising:

the first bottom panel and the first top panel having a first axial length; and the second bottom panel and the second top panel having a second axial length that is less than the first axial length.

5. The ceiling system according to claim 4 wherein along a first side of a perimeter of the open cell grid structure, left side edges of certain ones of the first bottom panels, the first top panels, the second bottom panels, and the second top panels are aligned with one another along a first plane; and wherein along a second side of the perimeter of the open cell grid structure that is opposite the first side, right side edges of other ones of the first bottom panels, the first top panels, the second bottom panels, and the second top panels are aligned with one another along a second plane.

6. The ceiling system according to claim 1 wherein each of the middle panel rows comprises first and second middle panels of different axial lengths arranged in axial alignment with one another so that a middle gap exists between adjacent side edges of the first and second middle panels, and wherein the middle gaps of transversely adjacent ones of the top panel rows are offset from one another in the axial direction.

7. The ceiling system according to claim 1 wherein:

each of the first and second bottom panels has a plurality of upper slots in the top edge;

each of the middle panels has a plurality of upper slots in the top edge of the middle panel and a plurality of lower slots in the bottom edge of the middle panel that are offset from the upper slots of the middle panel, the middle panel rows mounted to the bottom panel rows in the first intersecting arrangement so that the lower slots of the middle panels mate with the upper slots of the bottom panels to form primary intersection nodes; and each of the top panels has a plurality of lower slots in the bottom edge of the top panel, the top panel rows mounted to the middle panel rows in the second intersecting arrangement so that the lower slots of the top panels mate with the upper slots of the middle panels at secondary intersection nodes.

8. The ceiling system according to claim 7 wherein the middle panels are supported in the open cell grid structure solely due to the mating between the middle panels and the first and second bottom panels at the primary intersection nodes; and wherein the top panels are supported in the open cell grid structure solely due to the mating between the middle and top panels at the secondary intersection nodes.

9. The ceiling system according to claim 7 wherein the bottom edges of the middle panels and the first and second bottom panels are substantially flush with one another at the primary intersection nodes and the bottom edges of the middle panels and the top panels are substantially flush with one another at the secondary intersection nodes.

10. A method of installing a ceiling system comprising:

a) providing a first ceiling system kit comprising: (i) a plurality of first kit panels configured to mate with one another to form a first open cell grid structure when assembled; and (ii) first hanging hardware for hanging the first open cell grid structure;

b) providing a second ceiling system kit comprising: (i) a plurality of second kit panels configured to mate with one another to form a second open cell grid structure when assembled; and (ii) second hanging hardware for hanging the second open cell grid structure;

c) providing instructions how to mate the first and second kit panels to form a combined open cell grid structure in which no complete cell of the combined open cell grid structure has edge-to-edge interfaces or edge-to-edge gaps that oppose one another; and d) building the combined open cell grid structure using the first and second ceiling system kits in accordance with the instructions in an occupied space of a building in which the combined open cell grid structure is hung from a support structure by the first and second hanging hardware; wherein the plurality of first kit panels comprises:

a plurality of first bottom panels having a first axial length;

a plurality of first middle panels having the first axial length; and a plurality of first top panels having the first axial length;

wherein the plurality of second kit panels comprises:

a plurality of second bottom panel panels having a second axial length that is less than the first axial length;

a plurality of second middle panels having the first axial length; and a plurality of second top panels having the second axial length; and wherein step d comprises:

d-1) hanging the first bottom panels and the second bottom panels from the support structure using the first and second hanging hardware in a plurality of bottom panel rows, each of the bottom panel rows comprising one of the first bottom panels and one of the second bottom panels arranged in axial alignment with one another so that a bottom edge-to-edge gap exists between adjacent side edges of the first and second bottom panels, and wherein the bottom edge-to-edge gaps of transversely adjacent ones of the bottom panel rows are offset from one another in an axial direction of the bottom panel rows;

d-2) mounting the first and second middle panels to the bottom panel rows in a first intersecting arrangement with the bottom panel rows to form a plurality of middle panel rows; and d-3) mounting the first and second top panels to the middle panel rows in a second intersecting arrangement with the middle panel rows and a non-intersecting arrangement with the bottom panel rows to form a plurality of middle panel rows, each of the top panel rows comprising one of the first top panels and one of the second top panels arranged in axial alignment with one another so that a top edge-to-edge gap exists between adjacent side edges of the first and second top panels, and wherein the top edge-to-edge gaps of transversely adjacent ones of the top panel rows are offset from one another in an axial direction of the top panel rows.

11. The method according to claim 10 wherein step d-1) comprises:

d-1-1) forming a first one of the bottom panel rows by hanging one of the first bottom panels and one of the second bottom panels in axial alignment, a left side edge of the one of the first bottom panels located within a plane that perpendicular to an axial direction of the first one of the bottom panel rows; and d-1-2) forming a second one of the bottom panel rows by hanging another one of the first bottom panels and another one of the second bottom panels in axial alignment, a left side edge of the another one of the second bottom panels located within the plane.

12. The method according to claim 11 wherein step d-3) comprises:

d-3-1) forming a first one of the top panel rows by mounting one of the first top panels and one of the second top panels to the middle panel rows in axial alignment, a left side edge of the one of the first top panels located within the plane; and d-3-2) forming a second one of the top panel rows by hanging another one of the first top panels and another one of the second top panels in axial alignment, a left side edge of the another one of the second top panels locate within the plane.

13. The method according to claim 10 further comprising:

wherein step d-2) comprises mounting the first and second middle panels to the bottom panel rows by mating lower slots of the first and second middle panels with upper slots of the first bottom panels and the second bottom panels to form primary intersection nodes; and wherein step d-3) comprises mounting the first and second top panels to the middle panel rows by mating lower slots of the first and second top panels with the upper slots of the first and second middle panels to form secondary intersection nodes.

14. The method according to claim 10 wherein at least one of the first or second middle panels mates with both the one of the first bottom panels and the one of the second bottom panels.

15. The method according to claim 10 wherein the middle panel rows are supported in the combined open cell grid structure solely due to mating between the first and second middle panels and the first and second bottom panels; and wherein the top panel rows are supported in the open cell grid structure solely due to the mating between the first and second middle panels and the first and second top panels at the secondary intersection nodes.

16. A method of installing a ceiling system comprising:

a) hanging, from a support structure, a plurality of bottom panel rows in a non-intersecting arrangement with one another using hanging hardware, each of the bottom panel rows comprising a first bottom panel and a second bottom panel of different axial lengths arranged in axial alignment with one another so that a bottom gap exists between adjacent side edges of the first and second bottom panels, wherein the first and second bottom panels of adjacent rows of the bottom panel rows are staggered with one another;

b) mounting a plurality of middle panel rows to the bottom panel rows in a first intersecting arrangement with the bottom panel rows; and c) mounting a plurality of top panel rows to the middle panel rows in a second intersecting arrangement with the middle panel rows and a non-intersecting arrangement with the bottom panel rows, each of the top panel rows comprising a first top panel and a second top panel of different axial lengths arranged in axial alignment with one another, wherein the first and second top panels of adjacent rows of the top panel rows are staggered with one another, thereby forming an open cell grid structure.

17. The method according to claim 16 wherein the middle panel rows are supported in the open cell grid structure solely due to mating between the middle panels and the first and second bottom panels; and wherein the top panel rows are supported in the open cell grid structure solely due to the mating between the first and second top panels and the middle panels at the secondary intersection nodes.

18. The method according to claim 16 wherein one of the middle panels mates with both of at least one of the first bottom panels and at least one of the second bottom panels.

* * * * *